US012134017B2

(12) United States Patent
Slakey

(10) Patent No.: US 12,134,017 B2
(45) Date of Patent: Nov. 5, 2024

(54) BAT-AND-BALL SWING TRAINING PLATFORM

(71) Applicant: HOME RUN PRO, LLC., Sherman, TX (US)

(72) Inventor: Stuart Cameron Slakey, Sherman, TX (US)

(73) Assignee: Home Run Pro, LLC, Sherman, TX (US)

( * ) Notice: Subject to any disclaimer, the term of this patent is extended or adjusted under 35 U.S.C. 154(b) by 422 days.

(21) Appl. No.: 17/420,638

(22) PCT Filed: Dec. 27, 2019

(86) PCT No.: PCT/US2019/068816
§ 371 (c)(1),
(2) Date: Jul. 2, 2021

(87) PCT Pub. No.: WO2020/142392
PCT Pub. Date: Jul. 9, 2020

(65) Prior Publication Data

US 2022/0088453 A1 Mar. 24, 2022

Related U.S. Application Data

(60) Provisional application No. 62/788,241, filed on Jan. 4, 2019.

(51) Int. Cl.

| | |
|---|---|
| ***A63B 69/00*** | (2006.01) |
| ***A63B 71/06*** | (2006.01) |
| *A63B 102/18* | (2015.01) |

(52) U.S. Cl.
CPC ..... *A63B 69/0002* (2013.01); *A63B 71/0622* (2013.01); *A63B 2069/0008* (2013.01);
(Continued)

(58) Field of Classification Search
CPC ..... A63B 69/0002; A63B 2069/0008; A63B 2220/833
(Continued)

(56) References Cited

U.S. PATENT DOCUMENTS 5,037,094 A * 8/1991 Johnson ..... A63B 69/0002 473/272
5,810,673 A 9/1998 Castleberry
(Continued)

OTHER PUBLICATIONS

International Preliminary Report on Patentability in International Appln. No. PCT/US2019/068816, dated Jun. 16, 2021, 4 pages.
(Continued)

*Primary Examiner* — Mitra Aryanpour
(74) *Attorney, Agent, or Firm* — Fish & Richardson P.C.

(57) ABSTRACT

A bat-and-ball swing training platform (STP) apparatus includes a center frame coupled to a front panel and to a rear panel to create an STP base. A rotational platform is coupled to the center frame and accessible through the front panel for rotationally supporting a user's foot. Two balance beam panels are retained in pockets defined by the center frame. A balance beam engagement slot is used to couple a balance beam to the STP base, where the two balance beam panels are coupled to create the balance beam.

15 Claims, 24 Drawing Sheets

(52) U.S. Cl.
CPC ..... *A63B 2071/0625* (2013.01); *A63B 2071/0655* (2013.01); *A63B 2071/0694* (2013.01); *A63B 2102/18* (2015.10); *A63B 2102/182* (2015.10); *A63B 2210/50* (2013.01); *A63B 2220/833* (2013.01); *A63B 2225/09* (2013.01); *A63B 2225/20* (2013.01)

(58) Field of Classification Search
USPC ..... 473/452
See application file for complete search history.

(56) References Cited

U.S. PATENT DOCUMENTS 5,976,026 A * 11/1999 Erb ..... A63B 69/0002 473/270
6,945,883 B1 * 9/2005 Williams ..... A63B 69/0002 473/422
D602,553 S * 10/2009 Wright ..... D21/780
9,216,340 B2 * 12/2015 DelGreco ..... A63B 69/0002 473/452
9,486,683 B2 * 11/2016 Goodgame ..... A63B 69/0002 473/452
9,750,997 B2 * 9/2017 Frampton ..... A63B 5/22 473/452
2006/0046864 A1 * 3/2006 Pagano ..... A63B 69/3667 473/270
2006/0142099 A1 6/2006 Trucks
2006/0234816 A1 10/2006 Reason-Kerkhoff
2011/0224028 A1 * 9/2011 Slakey ..... A63B 69/0002 473/452
2014/0171213 A1 * 6/2014 Newman ..... A63B 69/0002 473/270
2019/0344123 A1 * 11/2019 Rubin ..... A63B 21/4043 482/5
2020/0338426 A1 * 10/2020 Di Prima ..... A63B 69/3673 473/452
2022/0088453 A1 * 3/2022 Slakey ..... A63B 71/0622 473/452

OTHER PUBLICATIONS

International Search Report and Written opinion in International Appln. No. PCT/US2019/068816, dated Mar. 3, 2020, 5 pages.

* cited by examiner

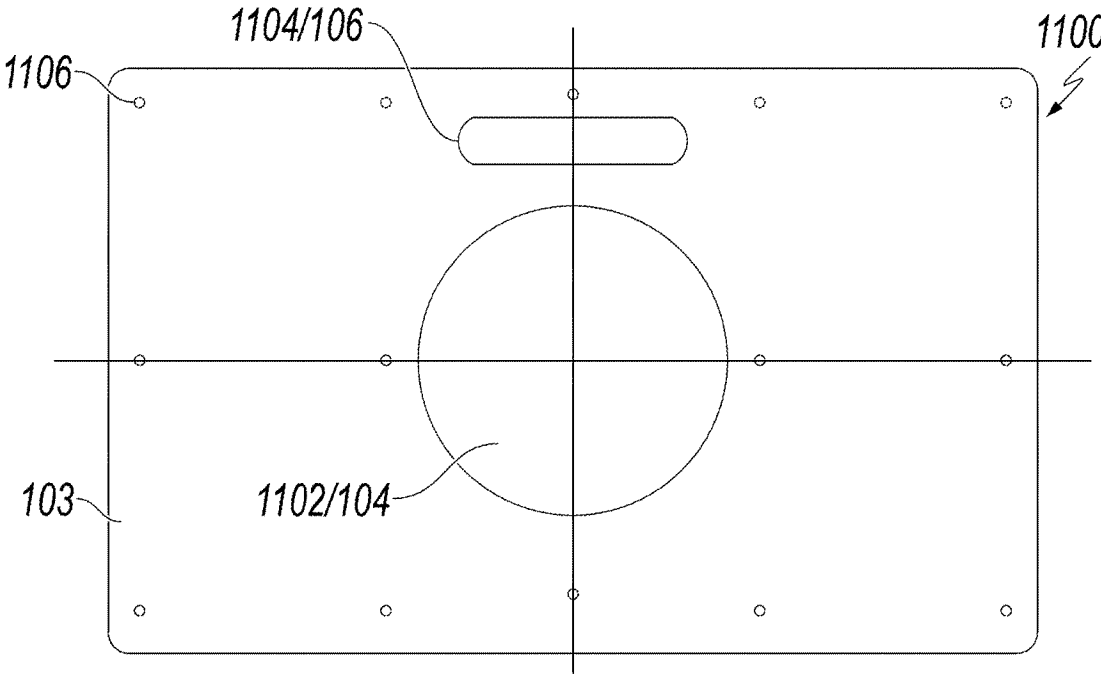
FIG. 11A1
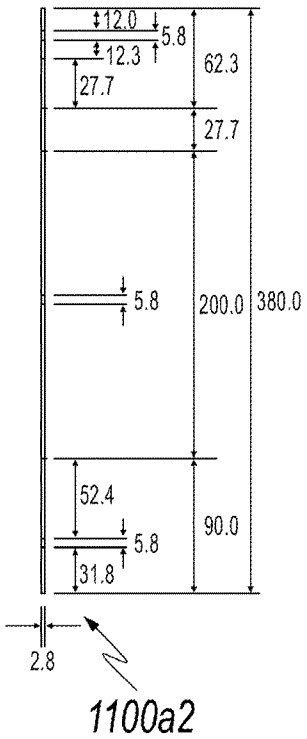
FIG. 11A2
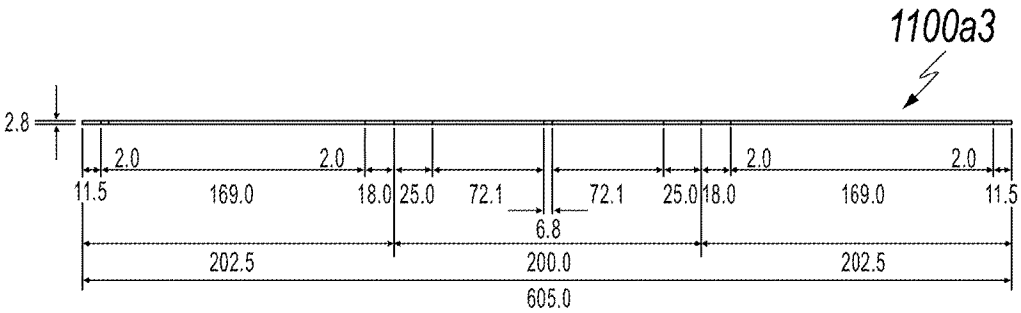
FIG. 11A3

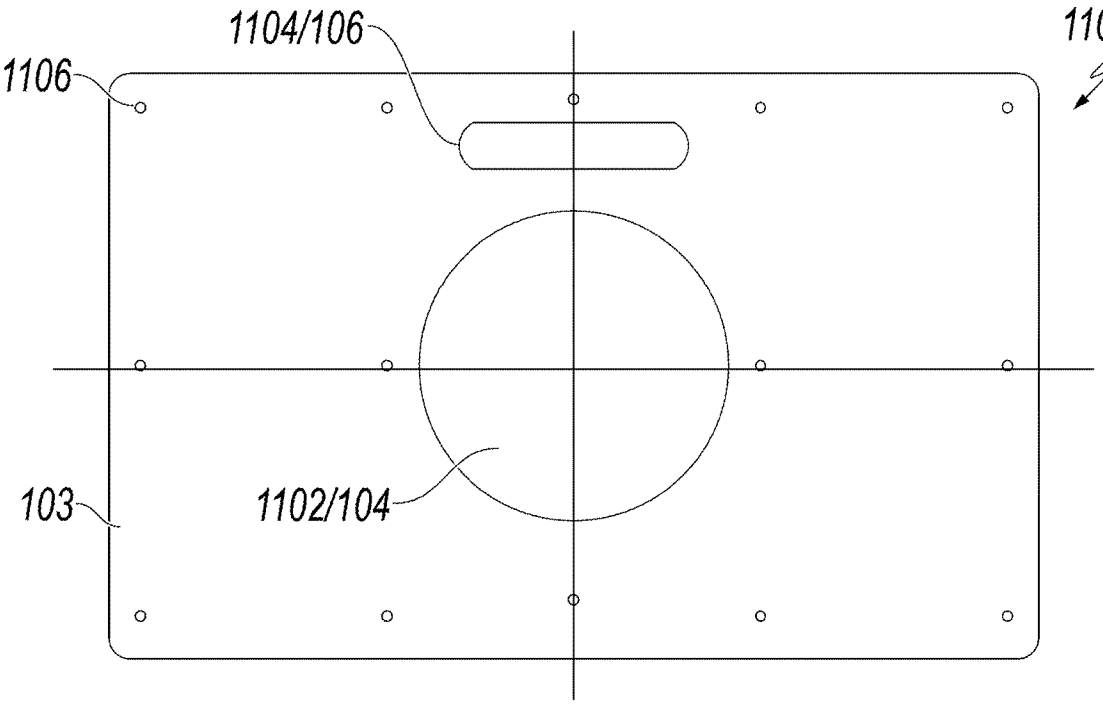
FIG. 11B1
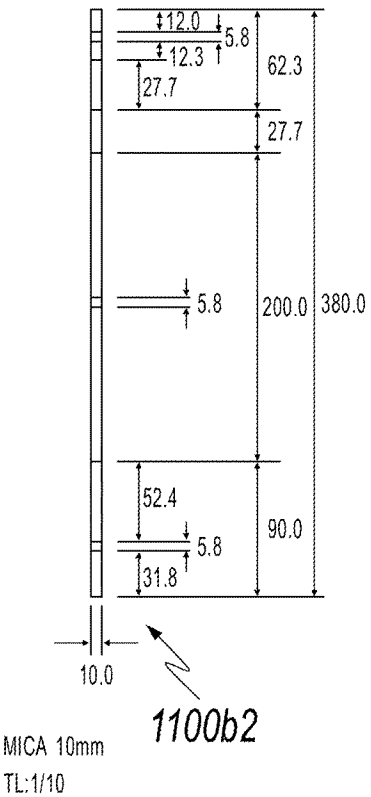
FIG. 11B2
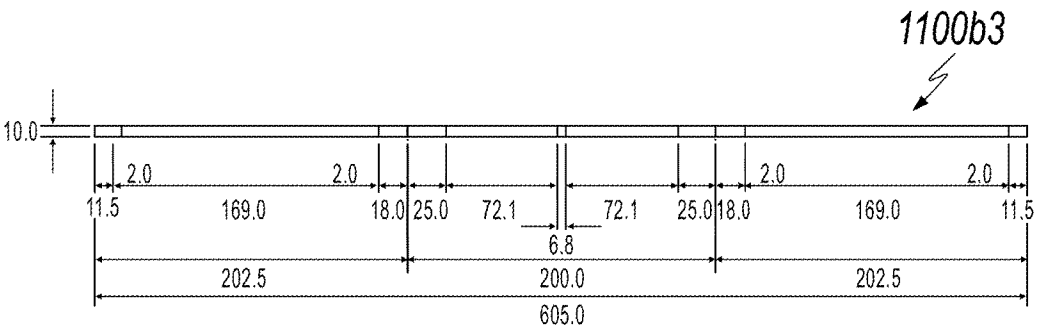
FIG. 11B3

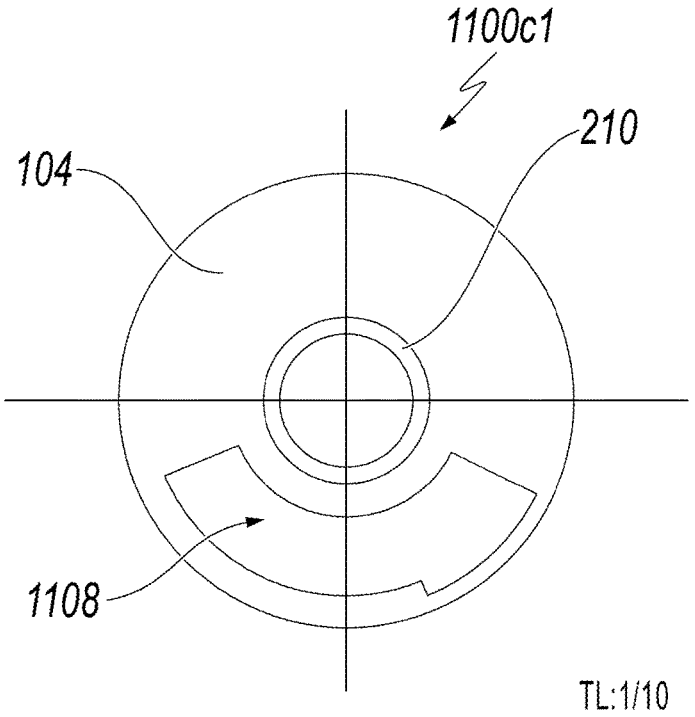
FIG. 11C1
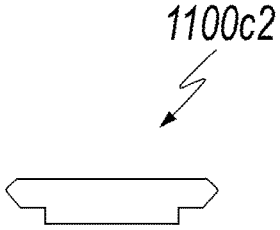
FIG. 11C2
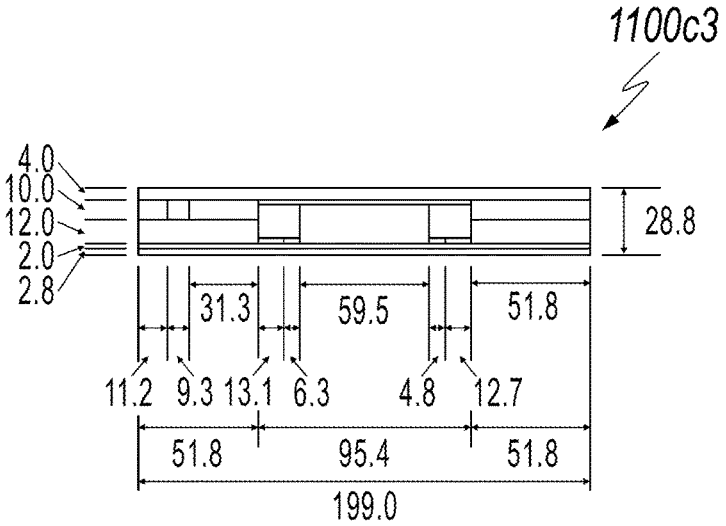
FIG. 11C3

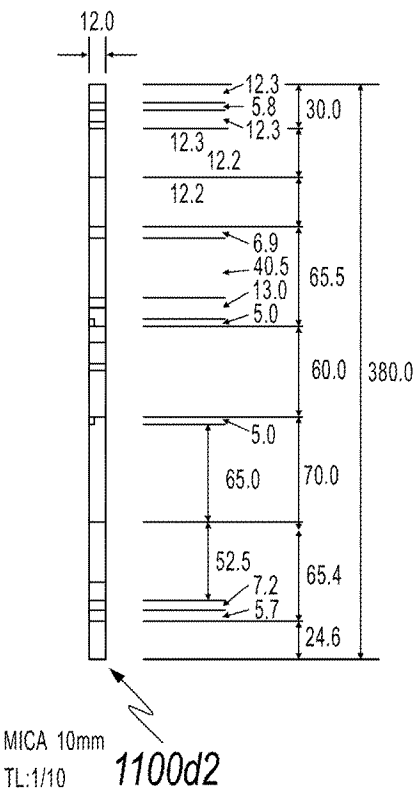
FIG. 11D2
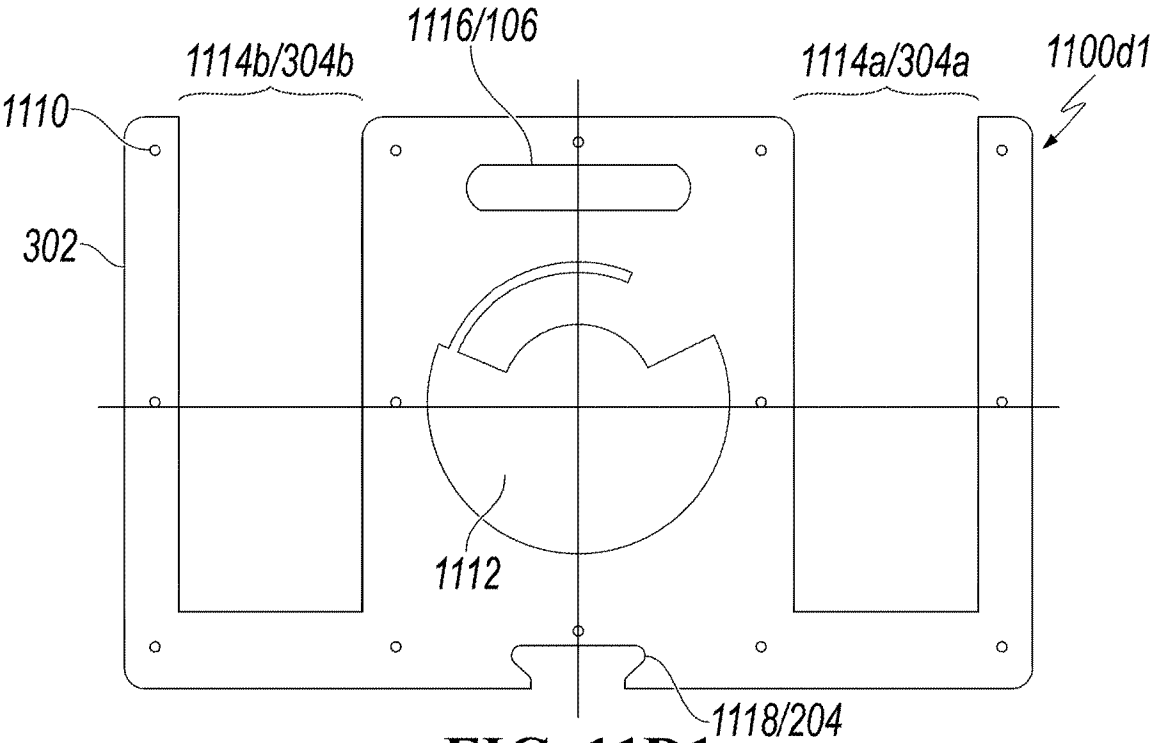
FIG. 11D1
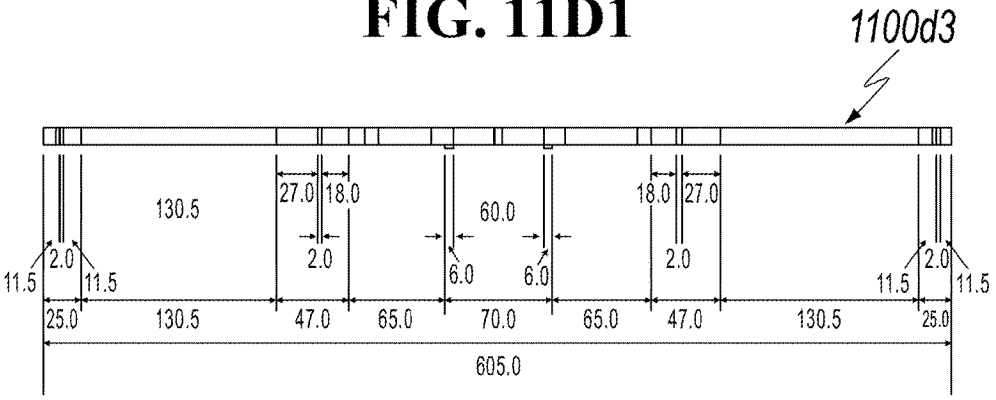
FIG. 11D3

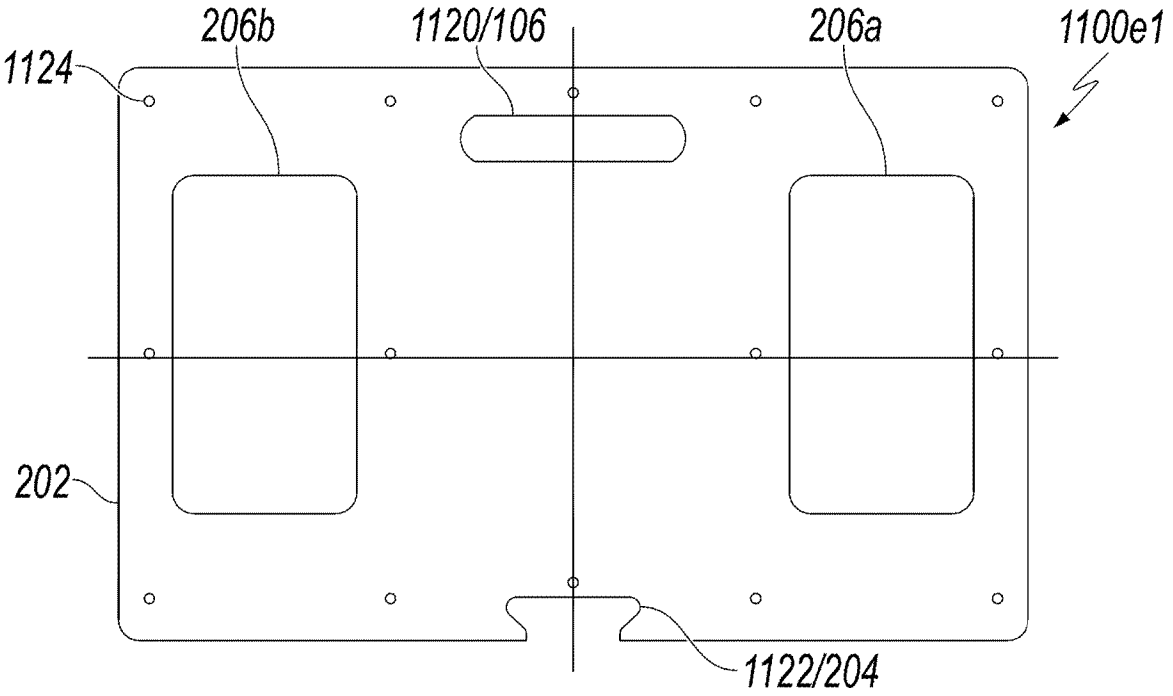
FIG. 11E1
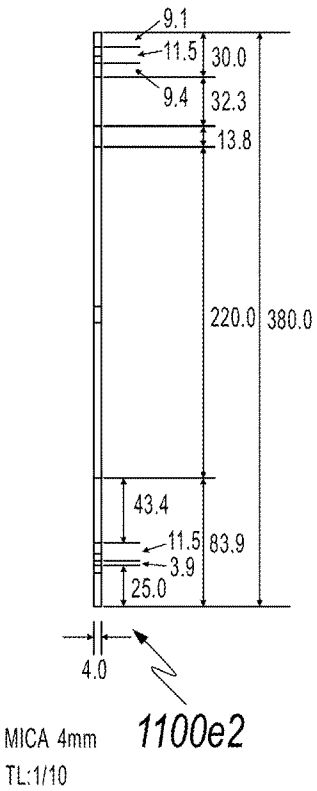
FIG. 11E2
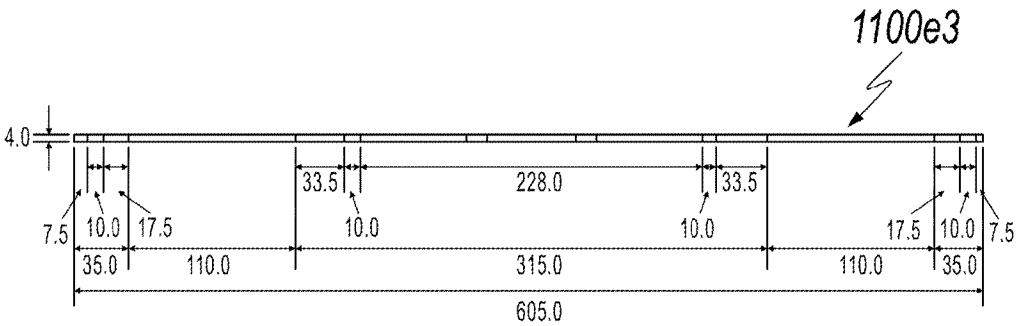
FIG. 11E3

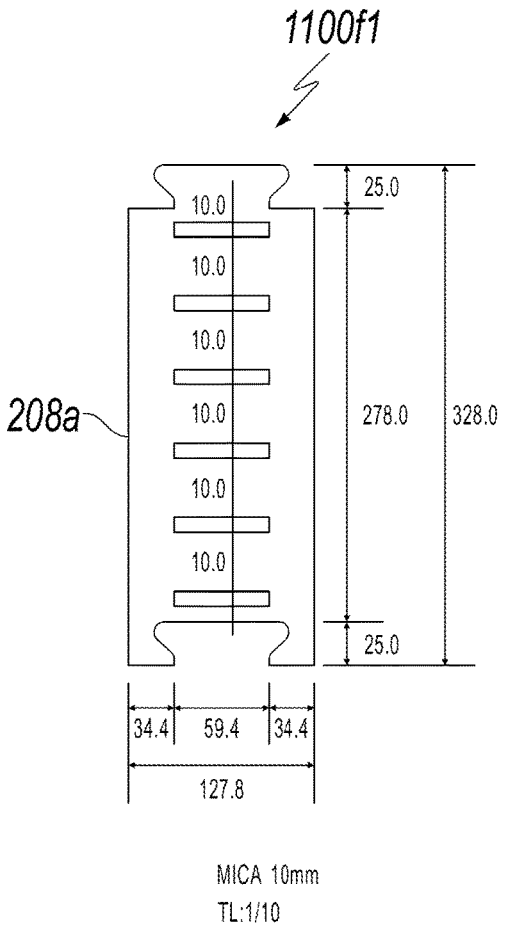
FIG. 11F1
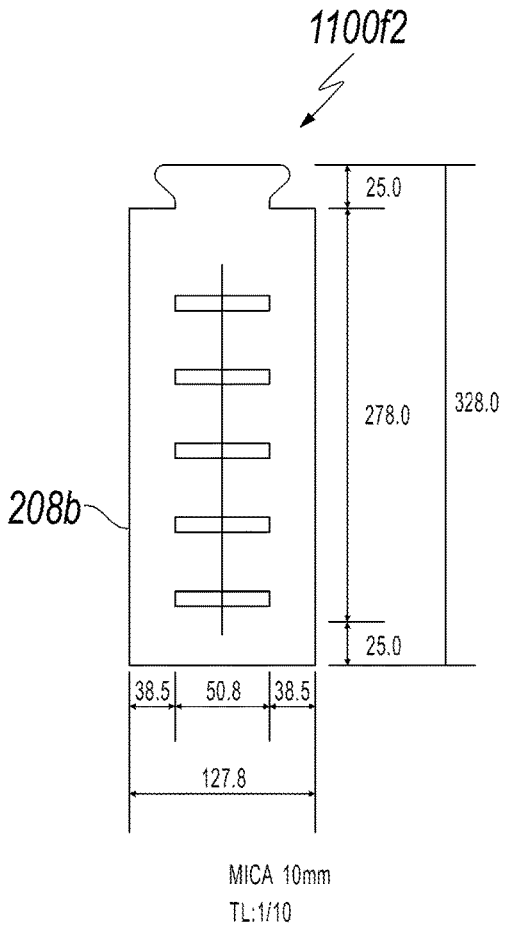
FIG. 11F2

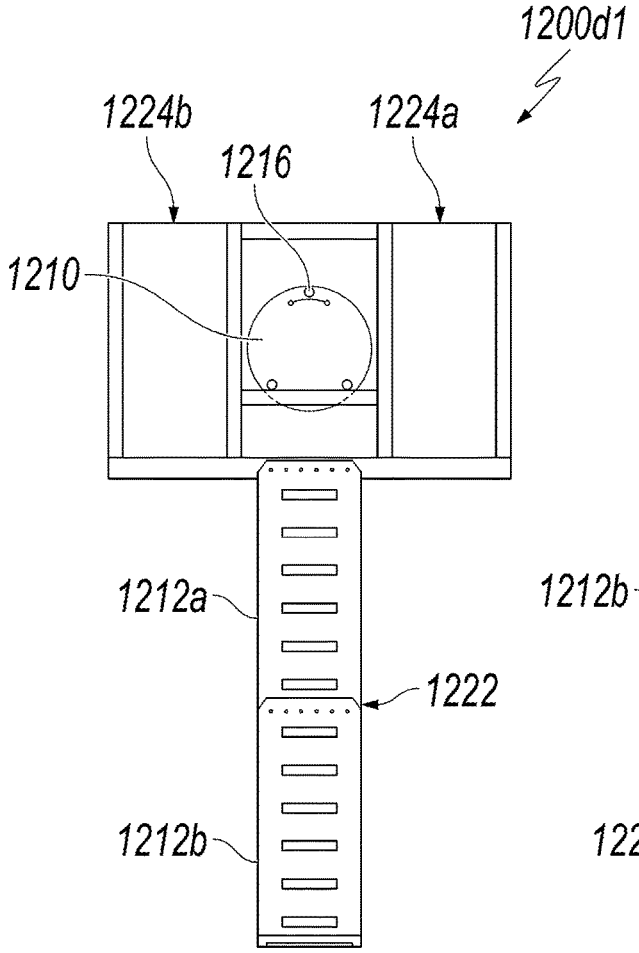
FIG. 12D1
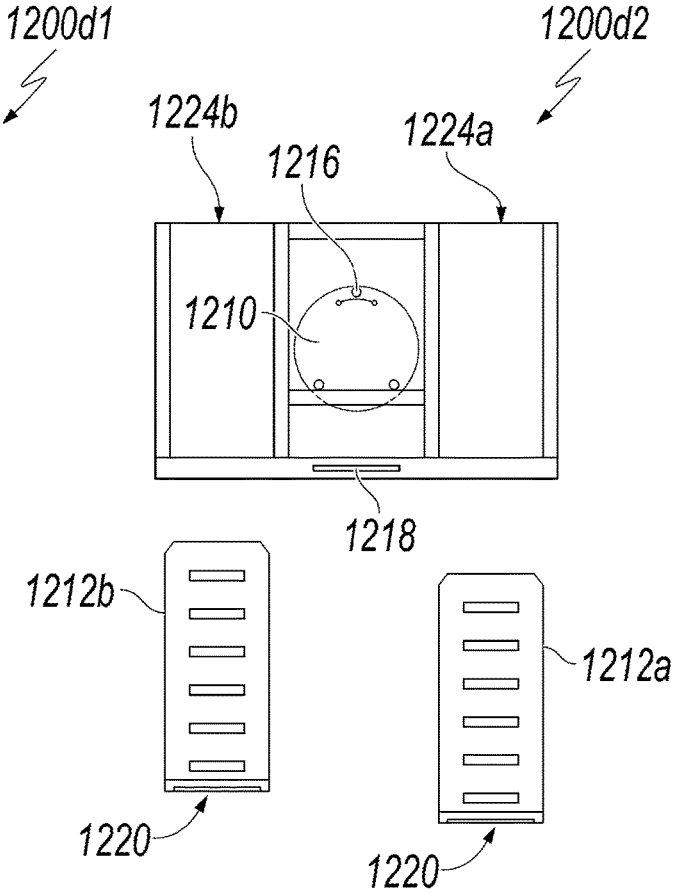
FIG. 12D2
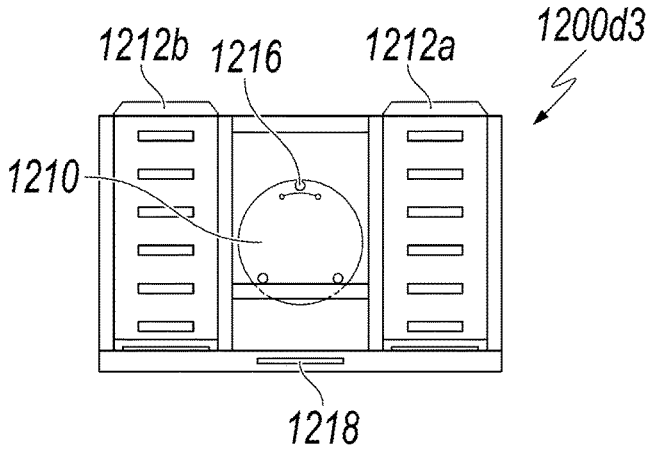
FIG. 12D3

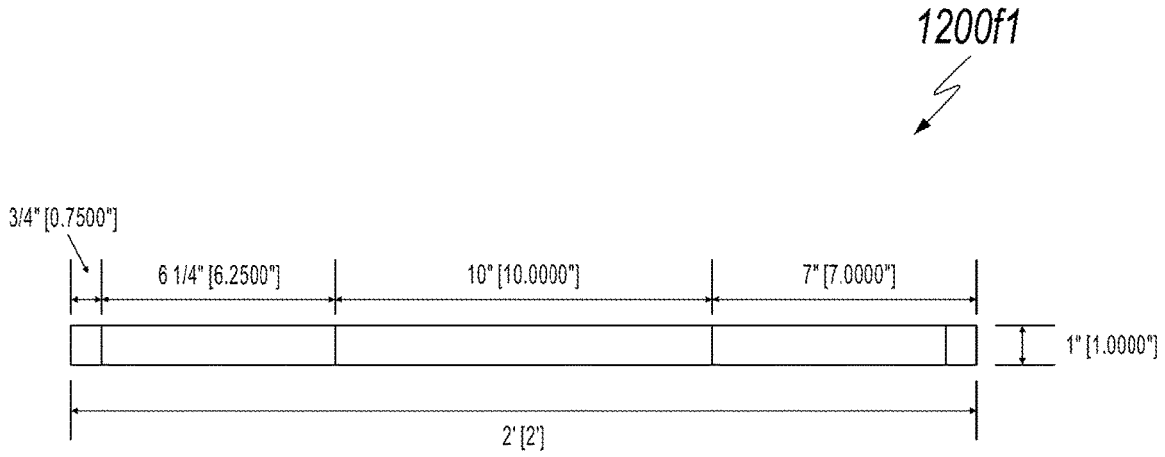
FIG. 12F1
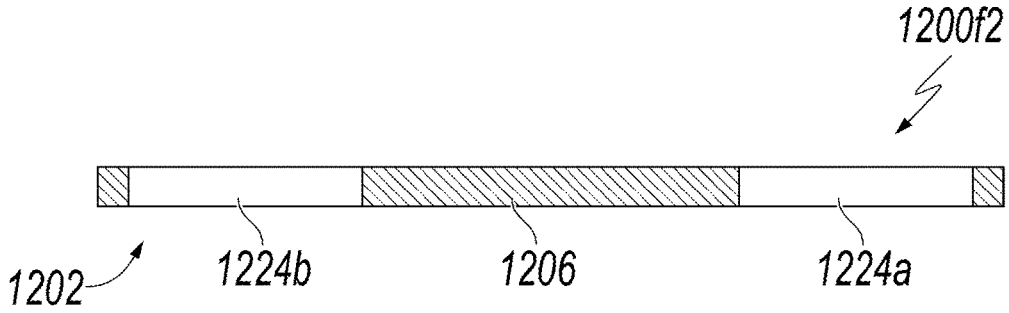
FIG. 12F2

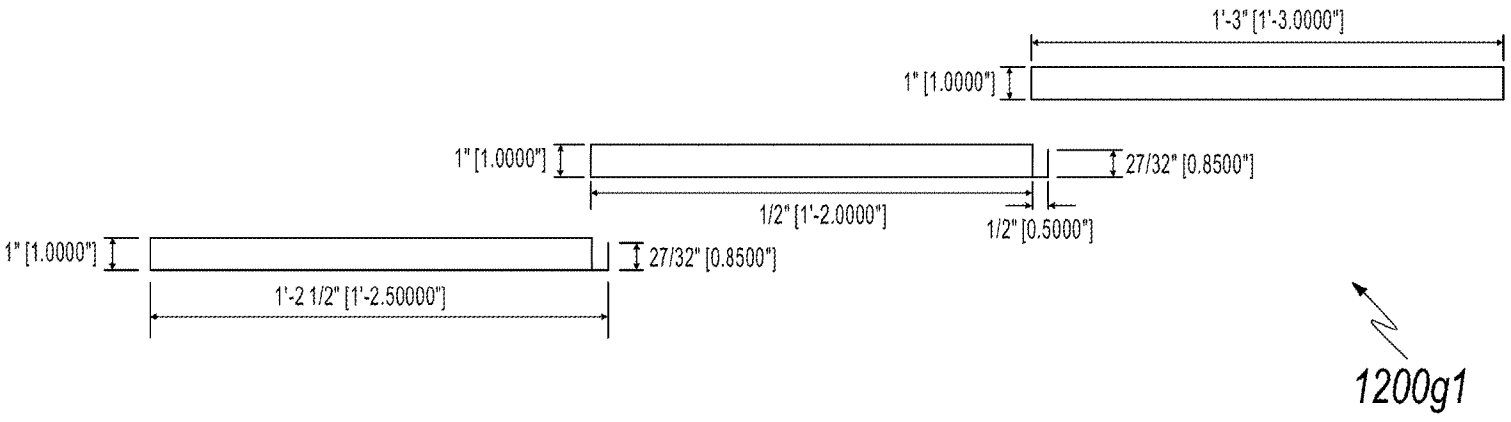
FIG. 12G1
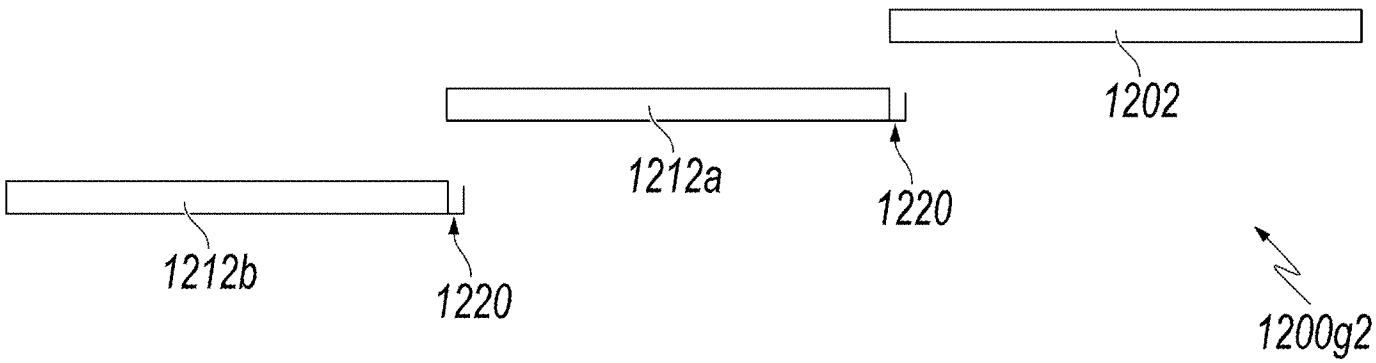
FIG. 12G2

BAT-AND-BALL SWING TRAINING PLATFORM

CLAIM OF PRIORITY

This application claims priority y to PCT Application No. PCT/US2019/068816 filed Dec. 27, 2019, and published as PCT Publication No.: WO 2020142392 A1, published Jul. 9, 2020: which claims priority to U.S. Provisional Patent Application No. 62/788,241, filed on Jan. 4, 2019, the entire contents of both and each are is hereby incorporated by reference.

BACKGROUND

In bat-and-ball type games (for example, baseball and softball), optimum batting performance requires a batter to develop proper body mechanics and muscle memory. As part of proper body mechanics, lower body considerations are integral to the development of a consistent swing technique. Placement and movement of feet are essential for providing a base for the upper body to swing a bat, make consistent contact with a ball, and to develop power and accuracy required to hit the ball in a consistent manner. Without developed body mechanics and muscle memory, a player's performance can be inconsistent and affect the overall success of a team.

SUMMARY

The disclosure describes a bat-and-ball swing training platform (STP).

In an implementation, a bat-and-ball STP apparatus includes a center frame coupled to a front panel and to a rear panel to create an STP base. A rotational platform is coupled to the center frame and accessible through the front panel for rotationally supporting a user's foot. Two balance beam panels are retained in pockets defined by the center frame. A balance beam engagement slot is used to couple a balance beam to the STP base, where the two balance beam panels are coupled to create the balance beam.

Some aspects of the described subject matter can be implemented using a computer-implemented method: a non-transitory, computer-readable medium storing computer-readable instructions to perform the computer-implemented method; and a computer-implemented system comprising one or more computer memory devices interoperably coupled with one or more computers and having tangible, non-transitory, machine-readable media storing instructions that, when executed by the one or more computers, perform the computer-implemented method/the computer-readable instructions stored on the non-transitory, computer-readable medium.

The subject matter described in this specification can be implemented to realize one or more of the following advantages. First, the STP permits a player to develop proper body mechanics with respect to bat swing technique for ball-and-bat type games (for example, baseball and softball). Second, the STP permits the player to develop muscle memory with respect to the proper body mechanics, helping to ensure more consistent and repeatable swing performance. Third, by helping to develop proper body mechanics and muscle memory, player batting power and accuracy can be increased. Fourth, the STP is configurable to an ergonomic, lightweight, and compact form factor to permit easy storage and transport (for example, by players, coaches, trainers, parents, or others). The configuration of the STP also permits easy setup and use. The ease of transport and setup are particularly helpful to encourage more frequent and consistent use to reinforce proper batting technique (for example, home use and scheduled practices). With repeated reinforcement of correct batting technique, a player's swing will improve over time as the player gains muscle memory needed to translate practice swings into actual gameplay. Fifth, the STP is relatively inexpensive and accessible to players from an amateur to a professional-level. Sixth, some implementations of the STP can be manufactured out of highly-robust materials (for example aluminum or composites) for expected heavy use (such as, at a professional-level). Seventh, repeated use will help to improve player confidence, performance, and overall team success. Eighth, the STP can be used by players who have suffered physical injuries to help retrain player muscles to rehabilitate proper swing/hit technique. Ninth, some implementations of the STP can be configured to gather, store, and provide data associated with, among other things, player balance, weight distribution, and hip rotation. This data can be used to track, among other things, player performance, improvement, and training. Tenth, the STP can be used to provide various notifications (for example, audio, visual, and haptic) to players, coaches, trainers, parents, or others.

The details of one or more implementations of the subject matter of this specification are set forth in the Detailed Description, exhibits, the Claims, and the accompanying drawings. Other features, aspects, and advantages of the subject matter will become apparent to those of ordinary skill in the art from the Detailed Description, the Claims, and the accompanying drawings.

DESCRIPTION OF DRAWINGS

FIGS. 11A1-11A3, 11B1-11B3, 11C1-11C3, 11D1-11D3, 11E1-11E3, and 11F1-11F2 are dimensional drawings illustrating components corresponding to the description of components for an example STP described in at least FIGS. 1-10, according to an implementation of the disclosure.

FIG. 11A1 is a dimensional drawing of a front panel, a cutout for a rotational platform, and a cutout for a carry handle corresponding to the description of components for an example STP described in at least FIGS. 1-10, according to an implementation of the disclosure.

FIG. 11A2 is a first relational side view illustrating dimensions of components of the example STP of FIG. 11A1, according to an implementation of the disclosure.

FIG. 11A3 is a second relational side view illustrating dimensions of components of the example STP of FIG. 11A1, according to an implementation of the disclosure.

FIG. 11B1 is a dimensional drawing of a front panel, a cutout for a rotational platform, and a cutout for a carry handle corresponding to the description of components for the example STP described in at least FIGS. 1-10, according to an implementation of the disclosure.

FIG. 11B2 is a first relational side view illustrating dimensions of components of the example STP of FIG. 11B1, according to an implementation of the disclosure.

FIG. 11B3 is a second relational side view illustrating dimensions of components of the example STP of FIG. 11B1, according to an implementation of the disclosure.

FIG. 11C1 is a dimensional drawing of a bottom of the rotational platform and a rotational bearing of the example STP corresponding to the description of components described in at least FIGS. 1-10, according to an implementation of the disclosure.

FIG. 11C2 is a relational side view of components of the example STP of FIG. 11C1, according to an implementation of the disclosure.

FIG. 11C3 is a relational side view illustrating dimensions of components of the example STP of FIG. 11C1, according to an implementation of the disclosure.

FIG. 11D1 is a dimensional drawing of a center frame corresponding to the description of components for the example STP described in at least FIGS. 1-10, according to an implementation of the disclosure.

FIG. 11D2 is a first relational side view illustrating dimensions of components of the example STP of FIG. 11D1, according to an implementation of the disclosure.

FIG. 11D3 is a second relational side view illustrating dimensions of components of the example STP of FIG. 11D1, according to an implementation of the disclosure.

FIG. 11E1 is a dimensional drawing of a back panel corresponding to the description of components for the example STP described in at least FIGS. 1-10, according to an implementation of the disclosure.

FIG. 11E2 is a first relational side view illustrating dimensions of components of the example STP of FIG. 11E1, according to an implementation of the disclosure.

FIG. 11E3 is a second relational side view illustrating dimensions of components of the example STP of FIG. 11E1, according to an implementation of the disclosure.

FIG. 11F1 is a dimensional drawing of a first balance beam panel corresponding to the description of components for the example STP described in at least FIGS. 1-10, according to an implementation of the disclosure.

FIG. 11F2 is a dimensional drawing of a second balance beam panel corresponding to the description of components for the example STP described in at least FIGS. 1-10, according to an implementation of the disclosure.

FIGS. 12A-12C, 12D1-12D3, 12E, 12F1-12F2, and 12G1-12G2 are engineering drawings of an alternative implementation of an STP, according to an implementation of the disclosure.

FIG. 12A is an exploded perspective drawing of elements of an alternative STP, according to an implementation of the disclosure.

FIG. 12B a perspective drawing of the alternative STP with balance beam panels removed for assembly, according to an implementation of the disclosure.

FIG. 12C is a top view drawing illustrating balance beam panel coupled to the balance beam engagement slot of the alternative STP, according to an implementation of the disclosure.

FIG. 12D1 is a bottom view drawing of the alternative STP with balance beam panels connected, according to an implementation of the disclosure.

FIG. 12D2 is a bottom view drawing of the alternative STP with balance beam panels disconnected, according to an implementation of the disclosure.

FIG. 12D3 is a bottom view drawing of the alternative STP with balance beam panels inserted into pockets, according to an implementation of the disclosure.

FIG. 12E illustrates example dimensions of a bottom view of an implementation of the alternative STP 1202, according to an implementation of the disclosure.

FIG. 12F1 illustrates an edge view of an implementation of the alternative STP 1202, according to an implementation of the disclosure.

FIG. 12F2 illustrates example dimensions of the edge view of FIG. 12F1, according to an implementation of the disclosure.

FIG. 12G1 illustrates a side view of an implementation of a relationship between the alternative STP and balance beam panels when set up for use of the alternative STP 1202, according to an implementation of the disclosure.

FIG. 12G2 illustrates example dimensions of the side view of FIG. 12G1, according to an implementation of the disclosure.

Like reference numbers and designations in the various drawings indicate like elements.

DETAILED DESCRIPTION

Figure 1:
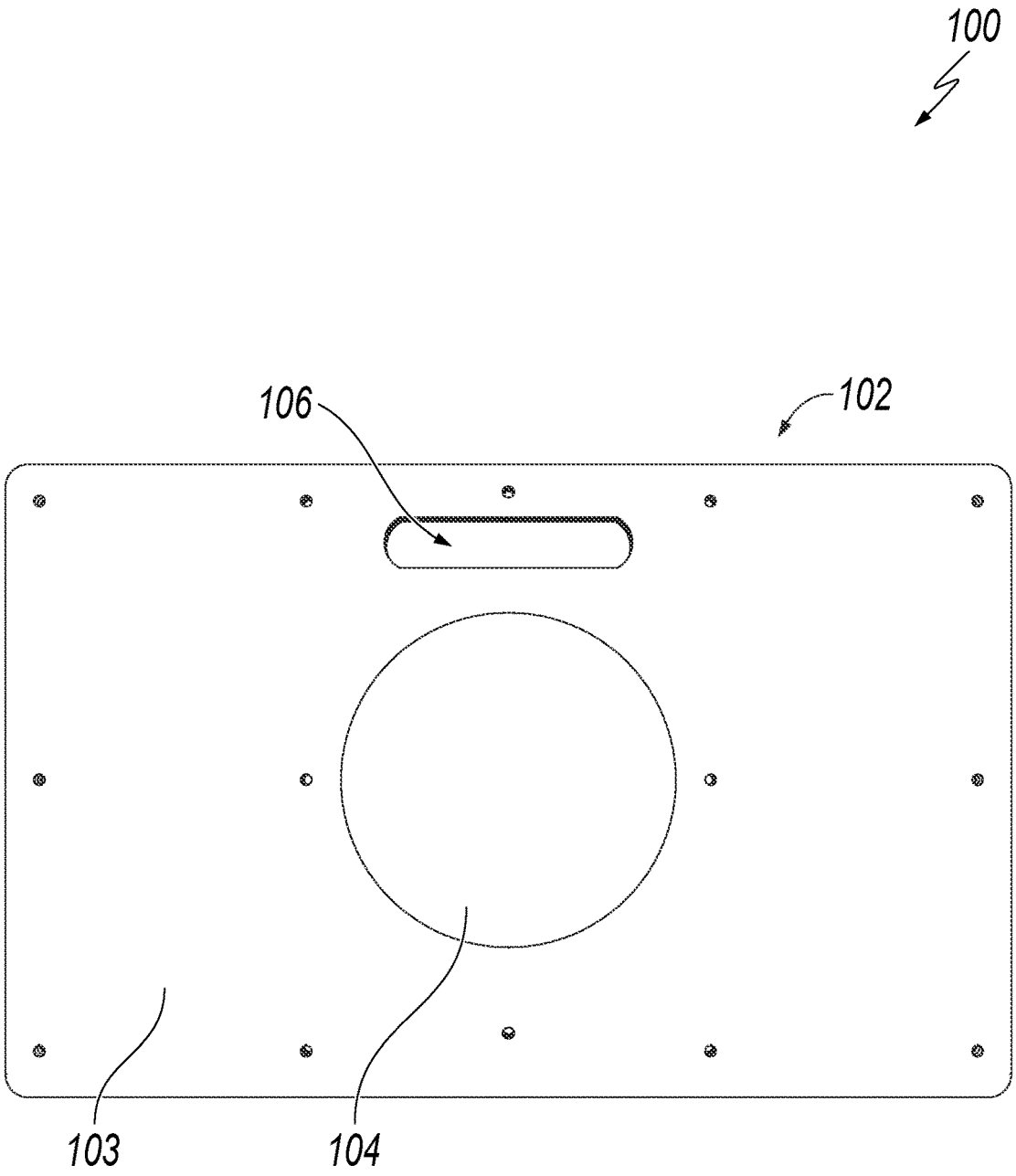
FIG. 1 is a top view of an example bat-and-ball swing training platform (STP), according to an implementation of the disclosure.

The following detailed description describes a bat-and-ball swing training platform (STP), and is presented to enable any person skilled in the art to make and use the disclosed subject matter in the context of one or more particular implementations. Various modifications, alterations, and permutations of the disclosed implementations can be made and will be readily apparent to those of ordinary skill in the art, and the general principles defined can be applied to other implementations and applications, without departing from the scope of the disclosure. In some instances, one or more technical details that are unnecessary to obtain an understanding of the described subject matter and that are within the skill of one of ordinary skill in the art may be omitted so as to not obscure one or more described implementations. The disclosure is not intended to be limited to the described or illustrated implementations, but to be accorded the widest scope consistent with the described principles and features.

In bat-and-ball type games (for example, baseball and softball), optimum batting requires a batter to develop proper body mechanics and muscle memory. As part of proper body mechanics, lower body considerations are integral to the development of a consistent swing technique. Placement and movement of feet are essential to provide a base for the upper body to swing a bat, make consistent contact with a ball, and to develop batting power and accuracy required to hit the ball in a consistent manner. Without developed body mechanics and muscle memory, a player's performance can be inconsistent and affect player goals and overall success of a team.

With respect to proper body mechanics, lower-body variables to consider can include player balance, weight distribution, and hip rotation. Balance is important to ensure that a batting action is smooth and efficient to produce and to retain energy of a swing. Correct weight distribution and proper hip rotation maximize production of rotational energy in the swing. When one or more of these variables are lacking, player batting technique and performance can suffer.

Described is an ergonomic, lightweight, and compact apparatus designed to assist players from amateur to professional-levels with development of, among other things, proper body mechanics and muscle memory. The apparatus is configured for easy storage and transport (for example, by players, coaches, trainers, parents, or others). The configuration of the apparatus also permits easy setup and use. The ease of transport and setup are particularly helpful to encourage more frequent and consistent use to reinforce proper batting technique (for example, home use and scheduled practices). With repeated reinforcement of correct batting technique, a player's swing will improve over time as the player gains muscle memory needed to translate practice swings into actual gameplay. Repeated use will help to improve player confidence, performance, and overall team success. In some implementations, the described apparatus can be used by players who have suffered physical injuries to help retrain player muscles to rehabilitate proper swing/hit technique.

Some implementations of the apparatus can be manufactured out of highly-robust materials (for example aluminum or composites) for expected heavy use (such as at a professional-gaming-level). Some implementations of the apparatus can be manufactured in different sizes (for example, for smaller/younger players as opposed to adult/larger players). The provided illustrations are for example purposes only, to help with understanding, and do not illustrate all possible configurations of the apparatus. Inasmuch as the design and use of these other configurations are consistent with the described subject matter, they are considered to be within the scope of this disclosure.

In some implementations the apparatus can be configured (described in more detail in the following disclosure) to gather, store, and provide data associated with, among other things, player balance, weight distribution, and hip rotation. This data can be used to track, among other things, player performance, improvement, and training. In these and other implementations, the described apparatus can be used to provide various notifications (for example, audio, visual, and haptic) to players, coaches, trainers, parents, or others.

At a high-level, the STP works on the on the rotational energy of a back leg, which is used to drive the core of a player's body and hands (holding a batting instrument) to make contact with a ball. With rotation of the back leg, the player's hips rotate. Better/efficient rotation of the player's hips increase the force with which the player will hit the ball (that is, the player will hit "harder") and overall batting accuracy.

The design of the STP allows for the improvement of a player's balance with use of a balance beam and rotational platform configured to rotationally support the player's rear foot. The balance beam has an adjustable forefoot block that keeps the player's front foot closed (that is, separated by a consistent distance) with respect to the player's rear foot so that the player's feet will not open (or separate) and deplete the generated rotational energy of a swing.

The balance beam and the rotational platform assist a player in understanding a correct/preferred weight distribution with respect to a front and a back foot configuration (for example, 40% front foot and 60% back foot) that is needed for maximum rotational energy to be produced using the described apparatus. As a result, player balance, weight distribution, and rotational muscle memory improve over time with proper usage of the described apparatus.

FIG. 1 is a top view: 100 of an example STP 102, according to an implementation of the disclosure. As illustrated, the STP 102 is rectangular in shape and approximately 15" high, 24" wide (the long axis), and 1.5" thick (for example, refer to FIG. 3 for illustration of thickness). In the illustrated implementation, the STP 102 is approximately 15.5 lbs. in weight. The illustrated implementation is constructed mostly of mica, acrylic, and/or other plastics, with some components constructed of other materials (for example, aluminum or steel).

The illustrated STP 102 includes a front panel 103, rotational platform 104, and a carry handle 106 for transporting the apparatus. In some implementations, the front panel 103 is configured of a solid sheet of acrylic, plastic, or other material. In some implementations, the front panel 103 can include multiple pieces that are attached to STP 102. In some implementations, the rotational platform is configured of acrylic, plastic, or other material and rotationally supportive of a player's foot (for example, in conjunction with a rotational bearing). In the illustrated implementation of FIG. 1, the carry handle 106 is integrally defined by one or more elements of the STP 102. In other implementations, while not illustrated, the carry handle 106 can instead be separately attached to the STP 102 (for example, in a foldable, movable, or removable configuration).

Figure 2:
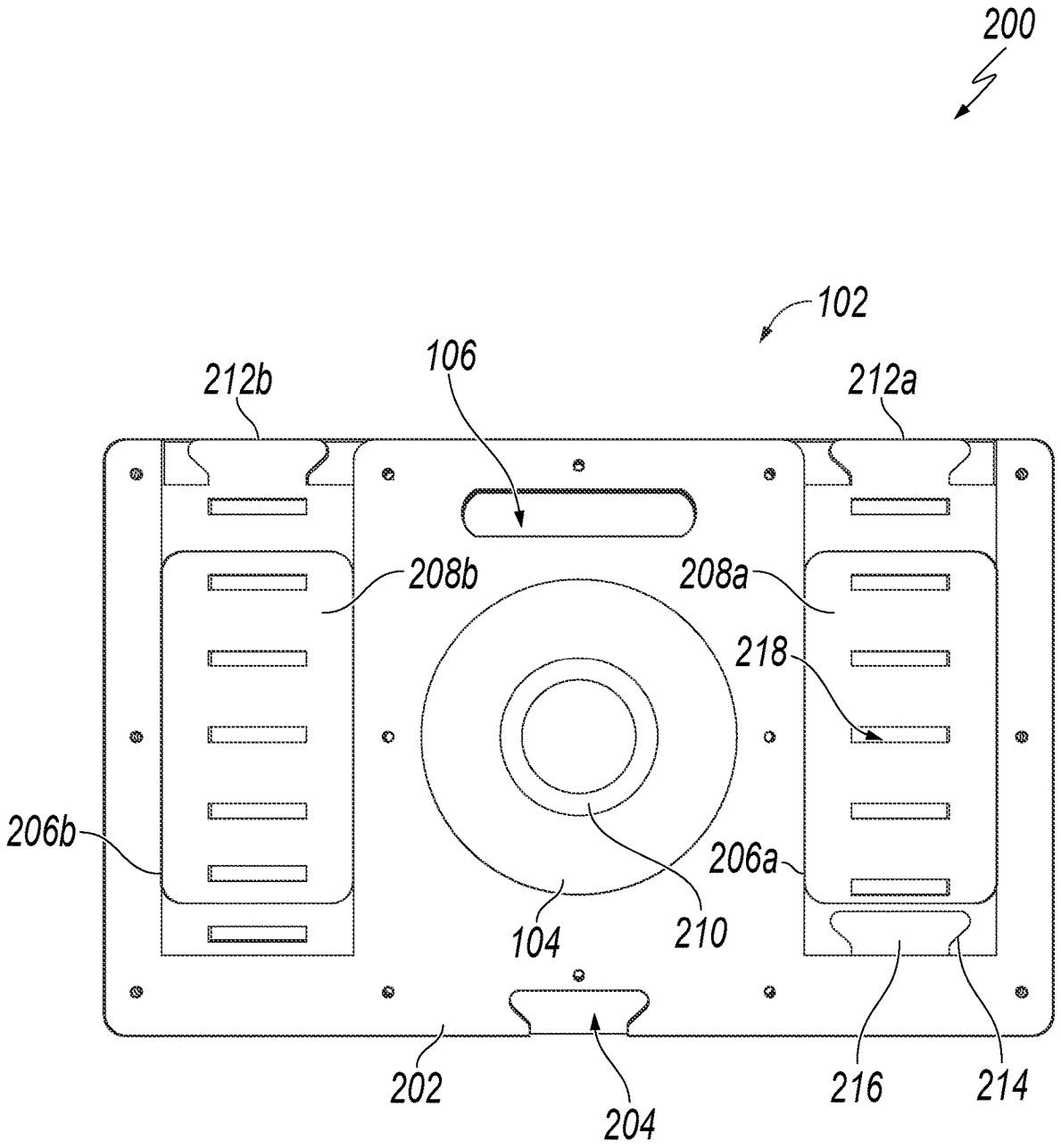
FIG. 2 is a bottom view of the example STP, according to an implementation of the disclosure.

FIG. 2 is a bottom view 200 of the example STP 102, according to an implementation of the disclosure. Note that the illustrated STP 102 is configured for demonstration purposes and does not necessarily reflect a final configuration. The changes necessary to convert the STP 102 into a production version should be apparent to one of ordinary skill in the art in light of this disclosure. As shown, the illustrated STP 102 includes a back panel 202, balance beam engagement slot 204, back panel cutouts 206*a*/206*b* (to demonstrate in a cut-away fashion balance beam panels 208*a*/208*b*, respectively), and rotational platform bearing 210.

Rotational bearing 210 is configured to permit the rotational platform 104 to rotate by a player's action. In some implementations, the degree of rotation of the rotational platform 104 can be limited by the rotational bearing 210 (for example to 90 degrees or 120 degrees counter-clockwise) or other structure (for example, an integral or attached rotational stop limiter). With respect to the back panel cutouts 206*a*/206*b*, it can be seen that the illustrated STP 102 is configured to permit the balance beam panels 208*a*/208*b* to be slideably inserted into the body of the STP 102 (at the front side edge proximate to the carry handle 106).

In some implementations and although not illustrated, the STP 102 can be configured to secure (with some mechanism) the balance beam panels 208*a*/208*b* within the STP 102. For example, the STP 102 can be configured with clamps, straps, latches, or other devices to permit the balance beam panels 208*a*/208*b* to be secured within the STP 102 when laid flat or if picked up with the carry handle 106 oriented in a downward position.

In typical implementations, the back panel 202 is a solid piece of acrylic or other material, whether configured to be opaque or with some degree of transparency. In some implementations, the back panel 202 can include multiple pieces that are attached to STP 102.

In some implementations and although not illustrated, the back panel 202 can be configured with feet or other protrusions/material to help secure the STP 102 when placed on the ground, floor, or other surface. For example, the feet or other protrusions can be configured of rubber, urethane, or other elastomeric material to "grip" and to protect a particular surface the STP 102 is used on. In some implementations, the back panel 202 can be configured of the elastomeric material or include a layer of the elastomeric material on all or a portion of the bottom surface of the STP 102.

Figure 8:
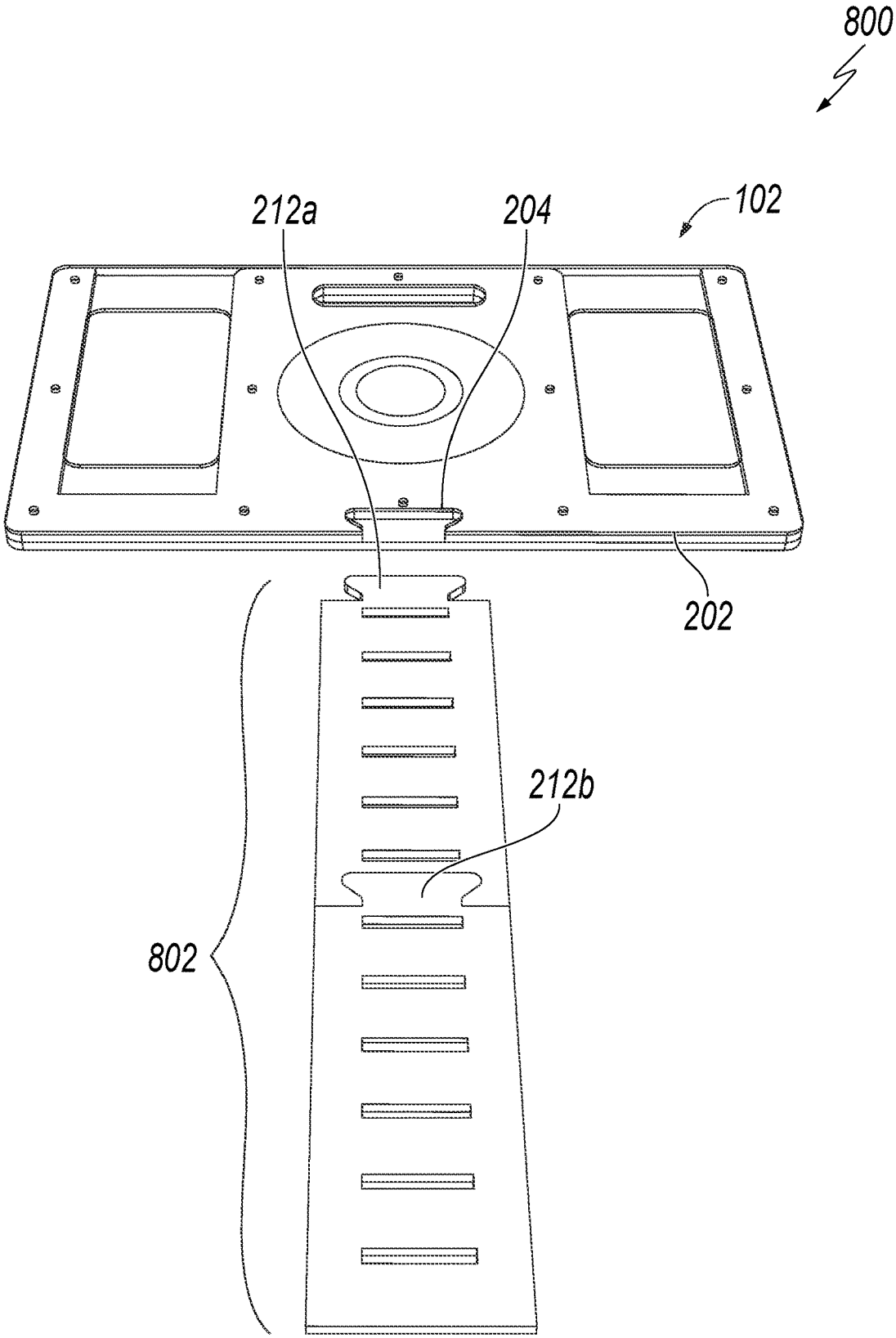
FIG. 8 is a bottom view of the example STP illustrating interlocked balance beam panels (as a balance beam) adjacent to a balance beam engagement slot, according to an implementation of the disclosure.
Figure 9:
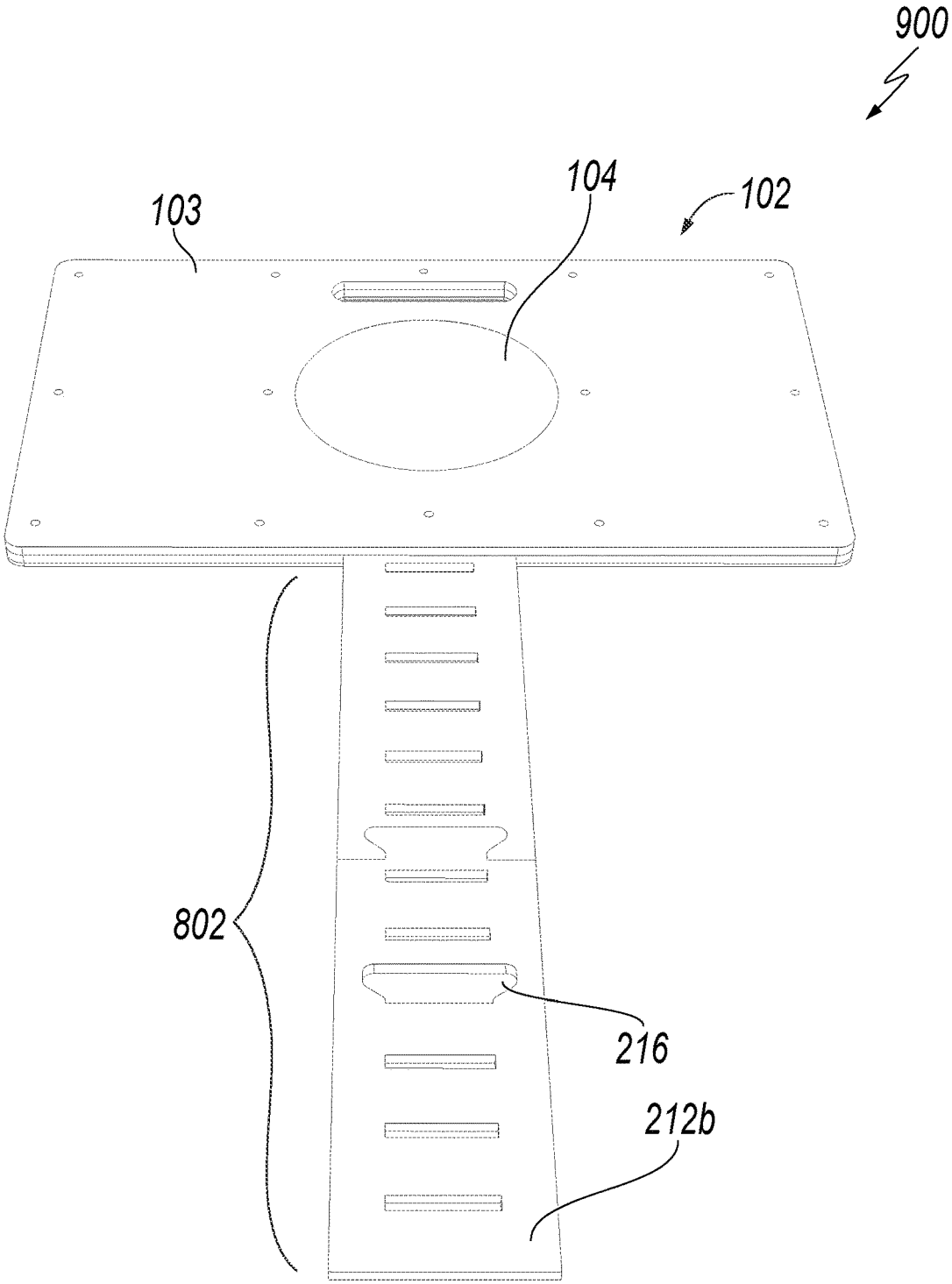
FIG. 9 is a top view of the example STP illustrating the balance beam coupled to the STP, according to an implementation of the disclosure.

The balance beam engagement slot 204 is used to couple a complete balance beam to the STP 102 (for example, see FIGS. 8 and 9). The balance beam engagement slot 204 is engaged by the interlocking member 212*a* of balance beam panel 208*a*. Note that balance beam panel 208*b* is also configured with an interlocking member 212*b* configured to couple with interlock slot 214 of balance beam panel 208*a*.

Also illustrated is an adjustable forefoot block 216 coupled to the balance beam panel 208*a* at the interlock slot 214. The adjustable forefoot block 216 is removed from the interlock slot 214 and inserted into one of adjustment slots 218 on either of balance beam panels 208*a*/208*b*, depending on a desired width of a player's stance (for example, refer to FIGS. 9 and 10).

In some implementations, the adjustment slots 218 can be configured with a layer of rubber or other material to ensure that the adjustable forefoot block 216 is held relatively securely in place within an adjustment slot 218 and maintains a substantially or actual 90 degree orientation with respect to the plane formed by a balance beam panel into which the adjustable forefoot block 216 is inserted.

n an implementation and to prepare the STP 102 for use, the STP 102 is placed top-down on a desired surface (for example, the ground at a batting practice area). Balance beam panels 208*a* and 208*b* are slideably removed from the STP 102. The adjustable forefoot block 216 is removed from the interlock slot 214 of balance beam 208*a*. Interlocking member 212*a* of balance beam panel 208*a* is fit into balance beam engagement slot 204 perpendicularly to the long axis of the STP 102. Balance beam panel 208*b* is coupled to the balance beam panel 208*a* with interlocking member 212*b* engaging with interlock slot 214 on balance beam panel 208*a*. In some implementations, the end of the balance beam panel 208*b* (that is, the terminating end of the balance beam) opposite to the interlocking member 212*b* is configured to be parallel to the long axis of the STP 102 and with no configured interlocking members or structures. The set up STP 102 is then turned over on the desired surface and the bottom surface of the STP 102 and the balance beam panels 208*a*/208*b* rest on the desired surface. The adjustable forefoot block 216 is inserted into a desired adjustment slot 218. The apparatus is ready for use. In some implementations, if the STP 102 is configured with sensors or other functionality, further interfacing with computing equipment, establishing settings, or other setup consistent with this disclosure may need to be performed prior to use.

Figure 3:
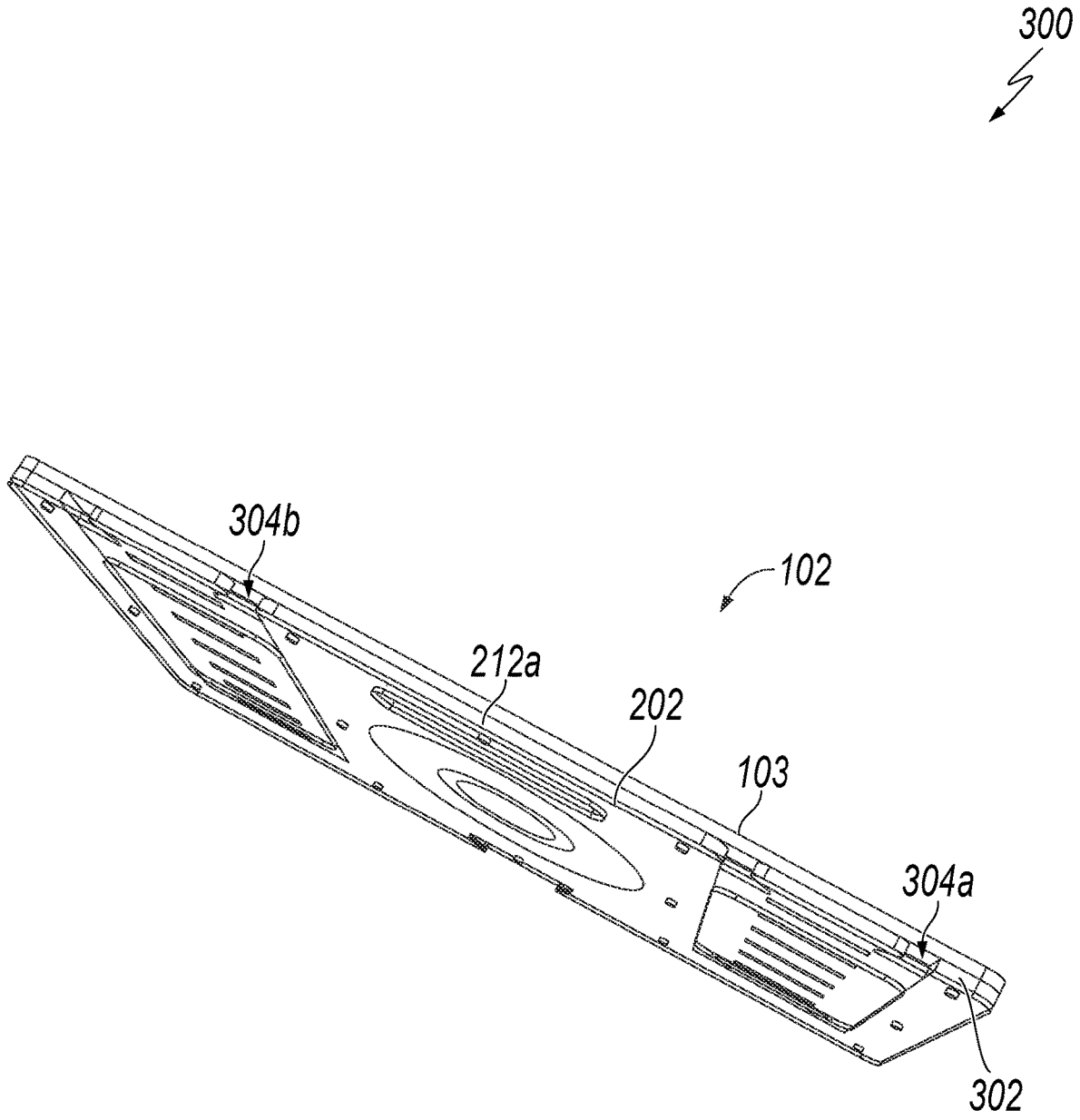
FIG. 3 is a front edge-on view of the example STP, according to an implementation of the disclosure.

FIG. 3 is a front edge-on view 300 of the example STP 102, according to an implementation of the disclosure. As can be seen in FIG. 3, at a high-level, the STP 102 is constructed in a tri-layer configuration with a front panel 103, the back panel 202, and a center frame 302. In typical implementations, the layers are coupled together with adhesive. In some implementations, the separate layers of the STP 102 can be coupled together using one or more of adhesive, fasteners (for example screws or bolts), clips, clamps, fusing with heat or chemical reaction, or other method consistent with this disclosure. The combination of the front panel 103, the back panel 202, and the center frame 302 form an STP base and define pockets 304*a* and 304*b* configured to hold/retain and release the balance beam panels 208*a*/208*b*, respectively. Although not illustrated, in some implementations, the balance beam panels 208*a*/208*b* can be retained in the pockets using one or more of friction, clips, clamps, retaining bands, or other retaining mechanism consisted with this disclosure. The balance beam panels 208*a*/208*b* are coupled together to form a balance beam (for example, refer to FIGS. 8 and 9) that is coupled to the STP base at the balance beam engagement slot 204.

Figure 4:
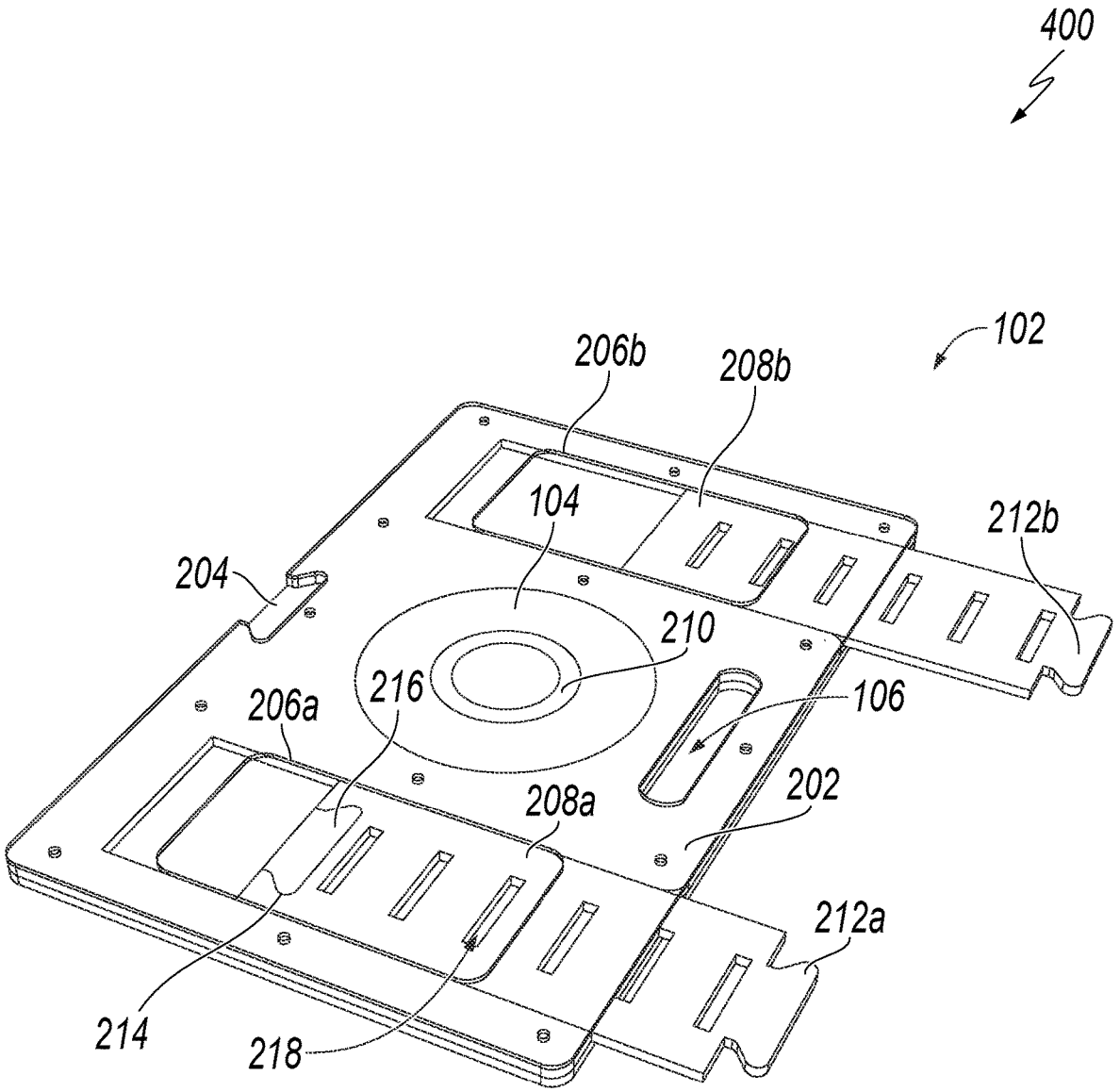
FIG. 4 is a bottom view of the example STP illustrating removal of balance beam panels from the STP, according to an implementation of the disclosure.

FIG. 4 is a bottom view 400 of the example STP 102 illustrating removal of balance beam panels 208*a*/208*b* from the STP 102, according to an implementation of the disclosure. A clearer view is enabled of the adjustable forefoot block 216 coupled to the balance beam panel 208*a* at the interlock slot 214 of balance beam panel 208*b*.

Figure 5:
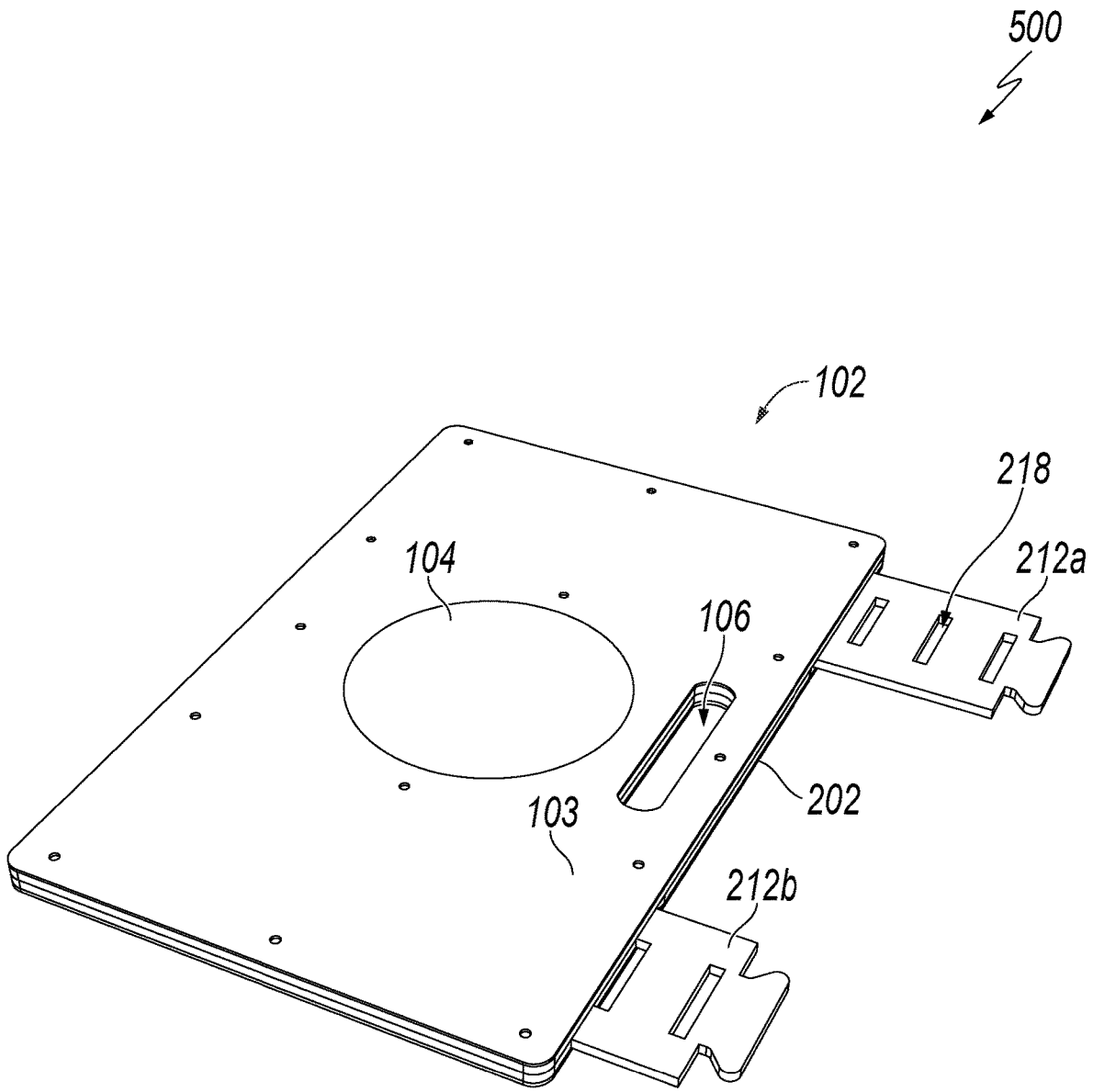
FIG. 5 is a top perspective view of the example STP illustrating removal of the balance beam panels, according to an implementation of the disclosure.

FIG. 5 is a top perspective view 500 of the example STP 102 illustrating removal of balance beam panels 208*a*/208*b*, according to an implementation of the disclosure. This orientation could represent the STP 102 laying on a desired practice surface or other surface and the balance beam panels 208*a*/208*b* being removed from the STP base prior to being coupled together and attached to the STP base at the balance beam engagement slot 204.

Figure 6:
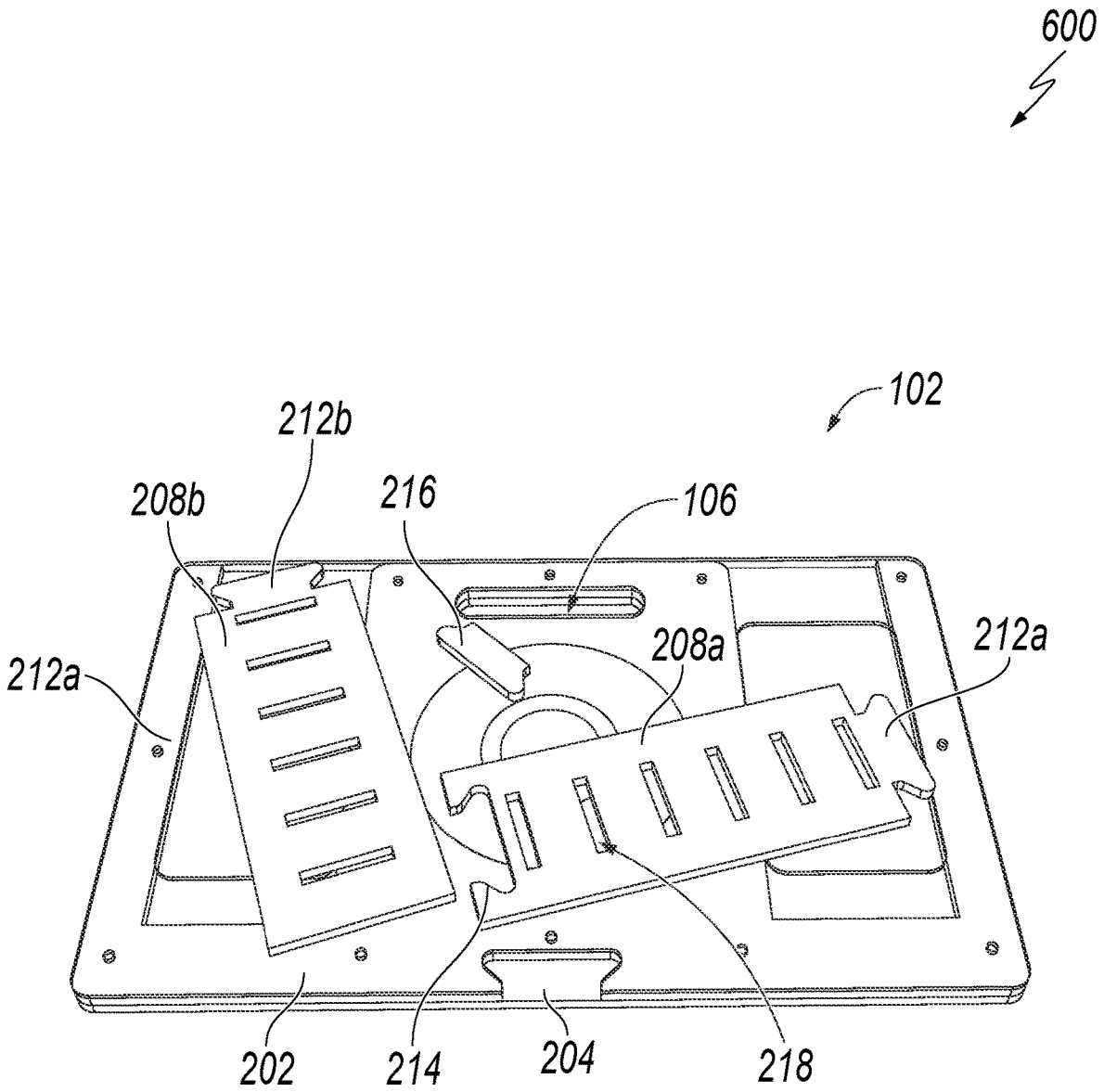
FIG. 6 is a bottom view of the example STP illustrating removed balance beam panels, according to an implementation of the disclosure.

FIG. 6 is a bottom view 600 of the example STP 102 illustrating removed balance beam panels, according to an implementation of the disclosure. Note that the adjustable forefoot block 216 has been removed from the interlock slot 214 of balance beam 208*a* to permit insertion into an adjustment slot 218 on balance beam panel 208*a*/208*b*.

Figure 7:
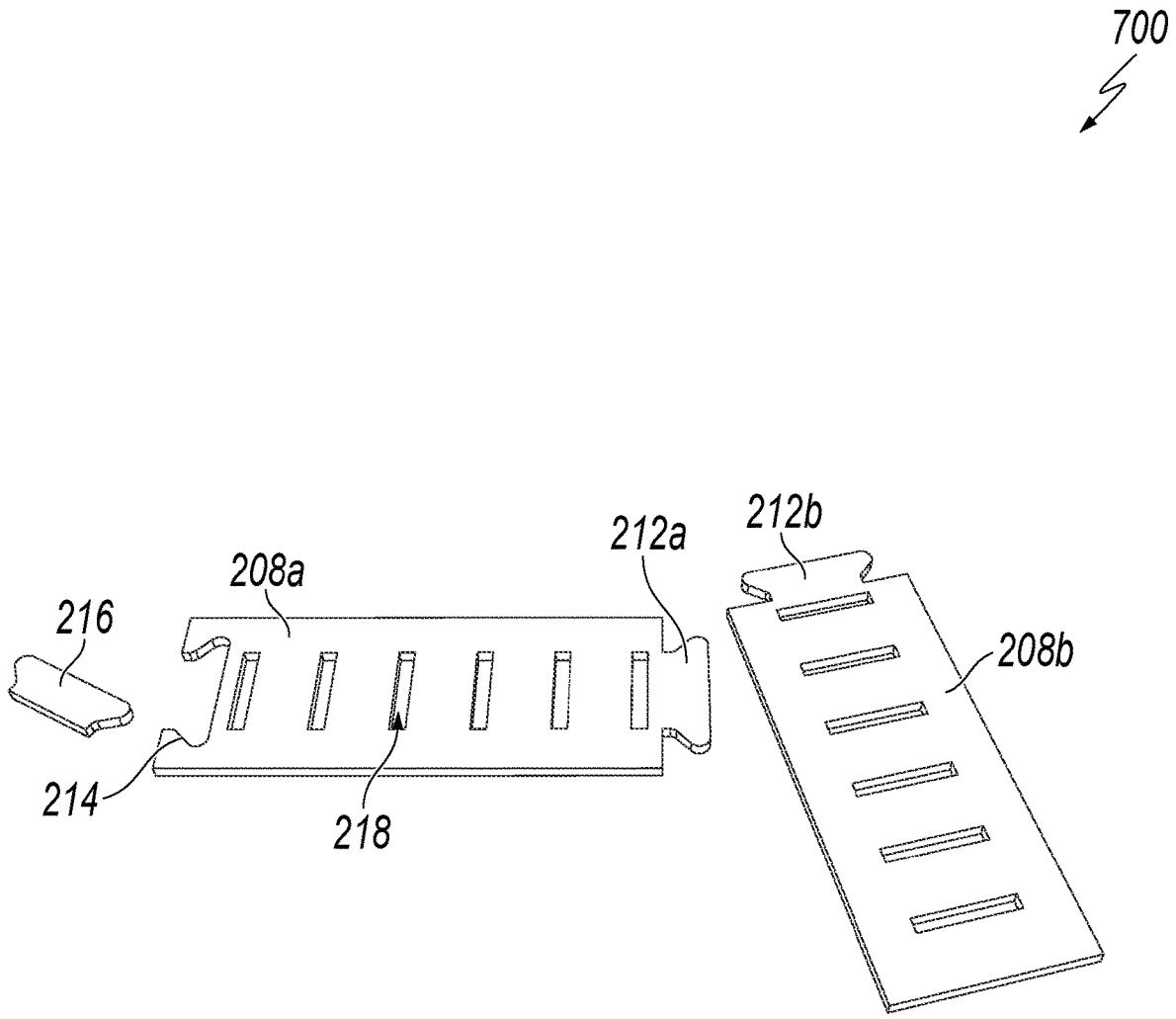
FIG. 7 is a view of the balance beam panels and an adjustable forefoot block, according to an implementation of the disclosure.

FIG. 7 is a view 700 of removed balance beam panels and adjustable forefoot block 216, according to an implementation of the disclosure. The adjustable forefoot block 216 can be inserted into an adjustment slot 218 on either of the balance beam panels 208*a*/208*b*. Interlocking member 212*b* of balance beam panel 208*b* is configured to couple with interlock slot 214 of balance beam panel 208*a*.

FIG. 8 is a bottom view 800 of the example STP 102 illustrating interlocked balance beam panels 208*a*/208*b* (collectively as balance beam 802) adjacent to balance beam engagement slot 204, according to an implementation of the disclosure. The interlocking member 212*a* of balance beam panel 208*a* is configured to couple with the balance beam engagement slot 204. Once the STP 102 and balance beam 802 are coupled together, the assembly can be turned over for use (for example, as illustrated in FIG. 9).

FIG. 9 is a top view 900 of the example STP 102 illustrating the balance beam 802 coupled to the STP 102, according to an implementation of the disclosure. Also illustrated is the adjustable forefoot block 216 installed into the balance beam 802. FIG. 9 shows that the example STP has been turned over and the back panel 202 has been placed on a surface.

Figure 10:
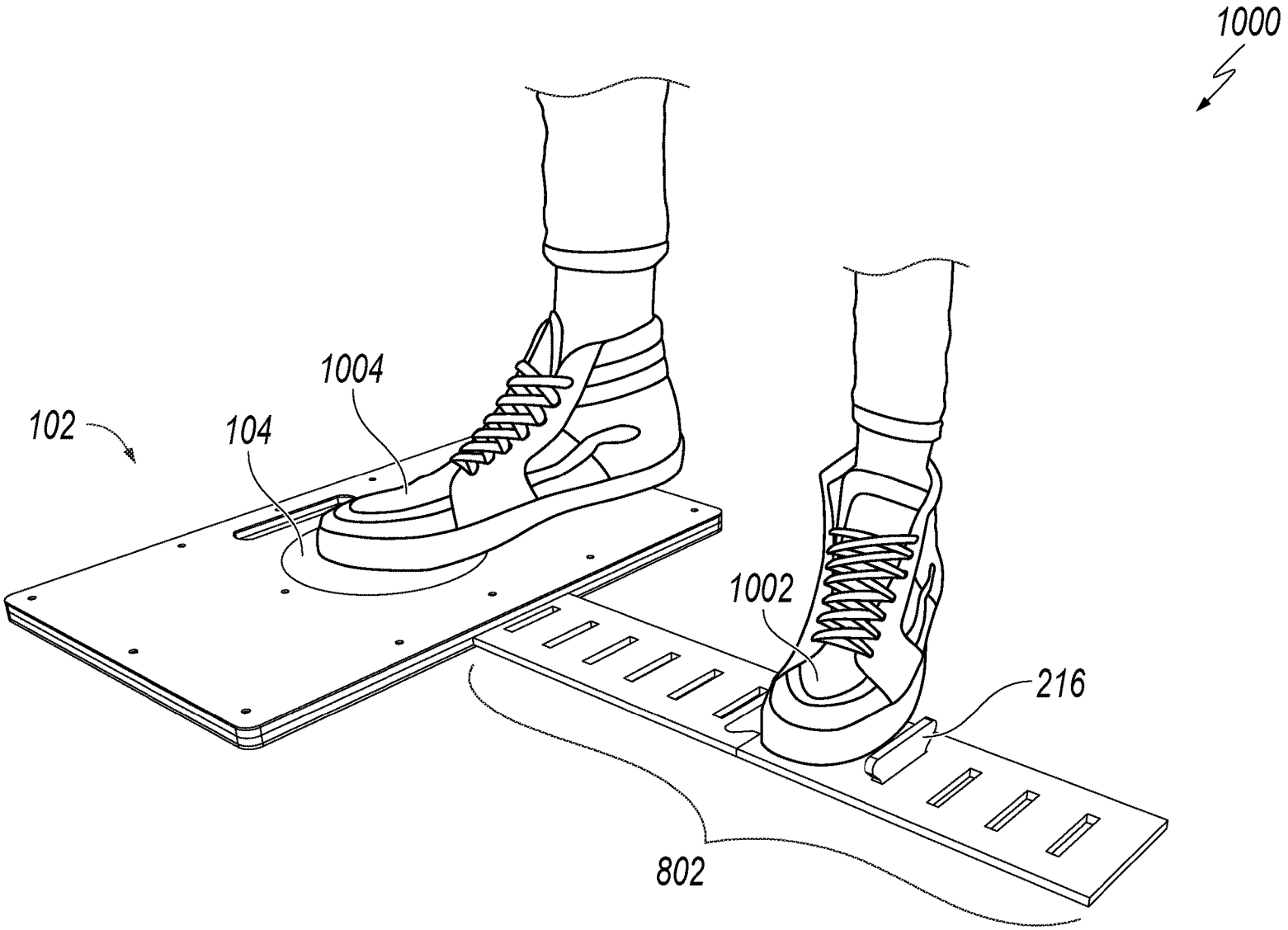
FIG. 10 is a top view of the example STP illustrating example foot placement with respect to the balance beam, the adjustable forefoot block, and the rotational plate, according to an implementation of the disclosure.

FIG. 10 is a top view 1000 of the example STP 102 illustrating example foot placement (forefoot 1002 and rear foot 1004—each represented with athletic shoes) with respect to the balance beam 802, the adjustable forefoot block 216, and the rotational plate 104, according to an implementation of the disclosure. As illustrated in FIG. 10, the forefoot 1002 is placed on the balance beam 802 at a desired stance width with the edge of the forefoot 1002 resting against the adjustable forefoot block 216 to retard the forefoot 1002 from moving further away from rear foot 1004. Note that the height of the adjustable forefoot block 216 is configured in such a manner (for example, a height of approximately 0.75") to allow the forefoot 1002 to slide over the adjustable forefoot block 216 or for the adjustable forefoot block 216 to detach from the balance beam 802 to prevent a user from tripping or otherwise injuring themselves if too much force is placed against the adjustable forefoot block 216.

The ball of the rear foot 1004 is placed on the rotational platform 104. In some implementations, the rotational platform 104 is configured to permit approximately 120 degrees of counter-clockwise motion before stopping. Other implementations can permit ranges of approximately 90 degrees to 150 degrees of counter-clockwise motion. Some implementations can be free spinning. In some implementations, an adjustment mechanism (not illustrated) can be configured as part of the STP 102 to permit the degree of rotation of the rotational platform 104 to be user-adjusted (for example, mechanically or using an application on a mobile device). In an instance, an adjustment mechanism can be made accessible to a user on the STP 102 (for example, on a side, the top, the bottom, or inside a pocket 304*a*/304*b*).

In some implementations, the rotational platform 104 can be configured to automatically return to a defined starting position once rotational force is removed from the rotational platform 104 (for example, a user removes the rear foot 1002 from the rotational platform 104).

FIGS. 11A1-11A3, 11B1-11B3, 11C1-11C3, 11D1-11D3, 11E1-11E3, and 11F1-11F2 are dimensional drawings 1100*a*1-1100*a*3, 1100*b*1-1100*b*3, 1100*c*1-1100*c*3, 1100*d*1-1100*d*3, 1100*e*1-1100*e*3, and 1100*f*1-1100*f*2, respectively, illustrating components corresponding to the description of components described in at least FIGS. 1-10, according to an implementation of the disclosure. FIGS. 11A1-11A3, 11B1-11B3, 11C1-11C3, 11D1-11D3, 11E1-11E3, and 11F1-11F2 illustrate one or more particular implementations with respect to size and configuration to assist with understanding of the described STP concept. With respect to material that is within the scope of the disclosure, FIGS. 11A1-11A3, 11B1-11B3, 11C1-11C3, 11D1-11D3, 11E1-11E3, and 11F1-11F2 are not meant to limit the disclosure in any way. Other dimensional values and materials consistent with the disclosure are also considered to be within the scope of the disclosure.

For example, FIGS. 11A1 and 11B1 are dimensional drawings 1100*a*1 and 1100*b*1, respectively, of the front panel 103, a cutout 1102 for the rotational platform 104, and a cutout 1104 for carry handle 106. As illustrated in FIGS. 11A1-11A3, 1100*a*1-1100*a*3, in some implementations, the front panel 103 can be configured of polycarbonate and can be 2.8 mm thick. In another implementation and as illustrated in FIGS. 11B1-11B3, 1100*b*1-1100*b*3, the front panel 103 can be configured of Mica (or Acrylic) (for example, manufactured by Fu Sheng Acrylic CO., LTD, located in the country of Vietnam) and can be 10 mm thick. In some implementations, front panel 103 can be configured to define a plurality of holes (for example, one of which is identified by 1106) that can be used to secure the front panel 103 to other components of an STP 102 (for example, with screws or bolts). Other implementations of the front panel 103 can be configured to include more, fewer, or no holes at all.

FIG. 11C1 is a dimensional drawing 1100*c*1 of the bottom of the rotational platform 104 and rotational bearing 210. In some implementations, the bottom surface of the rotational platform 104 can be configured to define a rotational limiter 1108 to limit rotational travel of the rotational platform (for example to 90 degrees or 120 degrees counter-clockwise). In other implementations, the rotational limiter 1108 can be a separate component that is attached to the rotational platform 104. FIG. 11C2 is a relational side view 1100*c*2 of components of the example STP of FIG. 11C1, according to an implementation of the disclosure. FIG. 11C3 is a relational side view: 100*c*3 illustrating dimensions of components of the example STP of FIG. 11C1, according to an implementation of the disclosure.

FIG. 11D1 is a dimensional drawing 1100*d*1 of center frame 302. As illustrated in FIGS. 11D1-11D3, 1100*d*1-1100*d*3, the center frame 302 can be configured of Mica and be 10 mm thick. As also illustrated, center frame 302 is configured to define a plurality of holes (for example, one of which is identified by 1110) that line up with holes 1106 as described in FIGS. 11A1 and 11B1 (also see holes 1124 in FIG. 11E1). Other implementations of the center 302 can be configured to include more, fewer, or no holes at all.

In the illustrated implementation, center frame 302 is also configured to define a corresponding rotational 5 limiter base 1112 that mechanically couples with rotational limiter 1108. In other implementations, the rotational limiter base 1112 can be a separate component that is attached to the center frame 302. In some implementations, the rotational limiter 1108 and rotational limiter base 112 can be coupled in a mechanical male/female relationship.

Center frame 302 is also configured to define pockets 1114*a*/114*b* (corresponding to pockets 304*a*/304*b*) to hold/retain and release balance beam panels 208*a*/208*b*, respectively. As illustrated, center frame 302 has also been configured to define a cutout 1116 for carry handle 106 and a cutout 118 for at least a portion of balance beam engagement slot 204.

As illustrated, FIG. 11E1 is a dimensional drawing 1100*e*1 of the back panel 202. In the illustrated implementation, back panel 202 has been configured to define back panel cutouts 206*a*/206*b*, a cutout 1120 for carry handle 106, and a cutout 1122 for at least a portion of balance beam engagement slot 204. In some implementations, back panel 202 can be configured to define a plurality of holes (for example, one or which is identified by 1124) that can be used to secure the back panel 202 to other components of an STP 102 (for example, with screws or bolts). Other implementations of the back panel 202 can be configured to include more, fewer, or no holes at all. FIG. 11E2 is a first relational side view 1100*e*2 illustrating dimensions of components of the example STP of FIG. 11E1, according to an implementation of the disclosure. FIG. 11E3 is a second relational side view 1100*e*3 illustrating dimensions of components of the example STP of FIG. 11E1, according to an implementation of the disclosure.

FIG. 11F1 is a dimensional drawing 1100*f*1 of balance beam panels 208*a*/208*b*. FIG. 11F2 is a dimensional drawing 1100*f*2 of a second balance beam panel corresponding to the description of components for the example STP described in at least FIGS. 1-10, according to an implementation of the disclosure. In the illustration of FIGS. 11F1-11F2, balance beam panels 208*a*/208*b* can be configured of mica and be 10 mm thick.

FIGS. 12A-12C, 12D1-12D3, 12E, 12F1-12F2, and 12G1-12G2 are drawings 1200*a*-1200*c*, 1200*d*1-1200*d*3, 1200*e*, 1200*f*1-1200*f*2, and 1200*g*1-1200*g*2 of an alternative implementation of an STP, according to an implementation of the disclosure. As will be appreciated by those of ordinary skill in the art, much of the description with respect to FIGS. 1-10 and 11A1-11A3, 11B1-11B3, 11C1-11C3, 11D1-11D3, 11E1-11E3, and 11F1-11F2 are applicable to elements of the alternative STP illustrated in FIGS. 12A-12C, 12D1-12D3, 12E, 12F1-12F2, and 12G1-12G2. Descriptive text in other portions of the disclosure, where consistent, should be considered applicable to the greatest extent possible unless specifically stated otherwise. Differences between the implementation of FIGS. 1-10 and will be described.

Figure 12A:
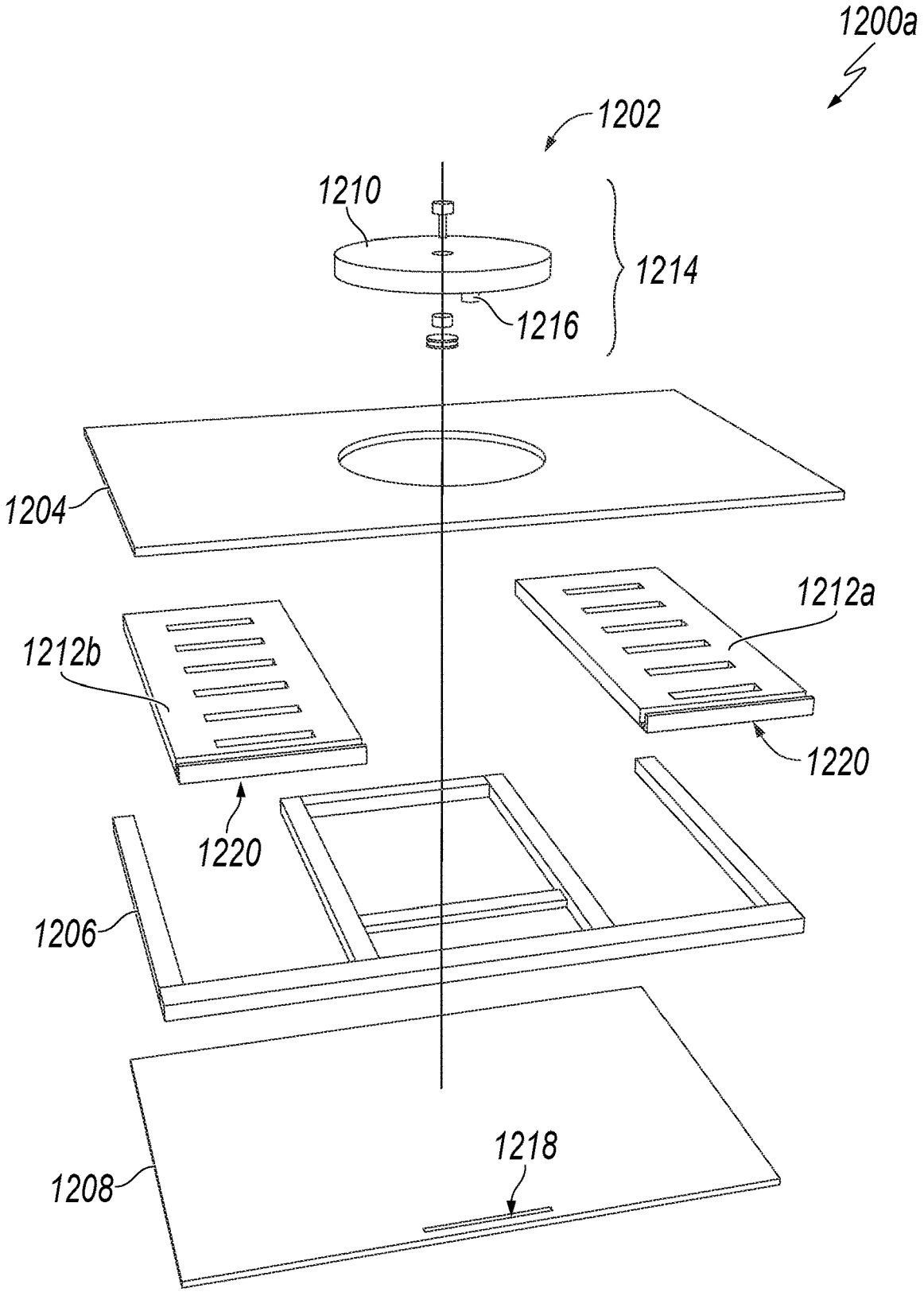

FIG. 12A is an exploded perspective drawing 1200*a* of elements of an alternative STP 1202. In some implementations, elements of the alternative STP 1202 are configured of aluminum. For example, front plate 1204, center frame 1206, back plate 1208, the rotational plate 1210, and balance beam panels 1212*a*/1212*b* can be made of aluminum sheeting, square 5 tubing, or other appropriate aluminum components.

Similar to the implementation(s) described in FIGS. 1-10 and 11A1-11A3, 11B1-11B3, 11C1-11C3, 11D1-11D3, 11E1-11E3, and 11F1-11F2, the balance beam panels are held/retained within the STP 1202 and slideably releasable. In some implementations and although not illustrated, the STP 1202 can be configured to secure (with some mechanism) the balance beam panels 1212*a*/1212*b* within the STP 1202. For example, the STP 1202 can be configured with clamps, straps, latches, or other devices to permit the balance beam panels 1212*a*/1212*b* to be secured within the STP 1202 when laid flat or if picked up with the carry handle (not illustrated) oriented in a downward position.

Although not illustrated, at least the front plate 1204, center frame 1206, and back plate 1208 can be configured to be fastened together with, for example, screws, bolts, adhesives, spot welding, or other applicable means. Also illustrated is that rotational plate 1210 can be mechanically coupled with the alternative STP 1202 using one or more bolts, screws, and washers 1214. In some implementations, the rotational plate 1210 is coupled to the rear panel 1208. Also illustrated as part of the rotational plate 1210 is a rotational stop limiter 1216 (one of possibly more than one in other implementations—for example, refer to FIGS. 12D1-12D3).

A balance beam engagement slot 1218 is also illustrated in back plate 1208. The center frame 1206 is also configured with a corresponding opening (not illustrated) to the balance beam engagement slot 1218. In some instances, the balance 25 beam engagement slot 1218 permits insertion of an edge of a "U" shaped channel/interlocking member 1220 (configured as part of each balance beam 1212*a*/1212*b*) into the balance beam engagement slot 1218. In some implementations, the interlocking member 1220 faces toward the bottom of the STP 1202, runs parallel to the length-wise axis of the alternative STP 1202, is in the middle and substantially at the 30 edge of the side of the alternative STP 1202 opposite to the openings receiving the balance beam panels 1212*a*/1212*b*, and configured to be approximately the width of a balance beam panel 1212*a*/1212*b*.

Figure 12B:
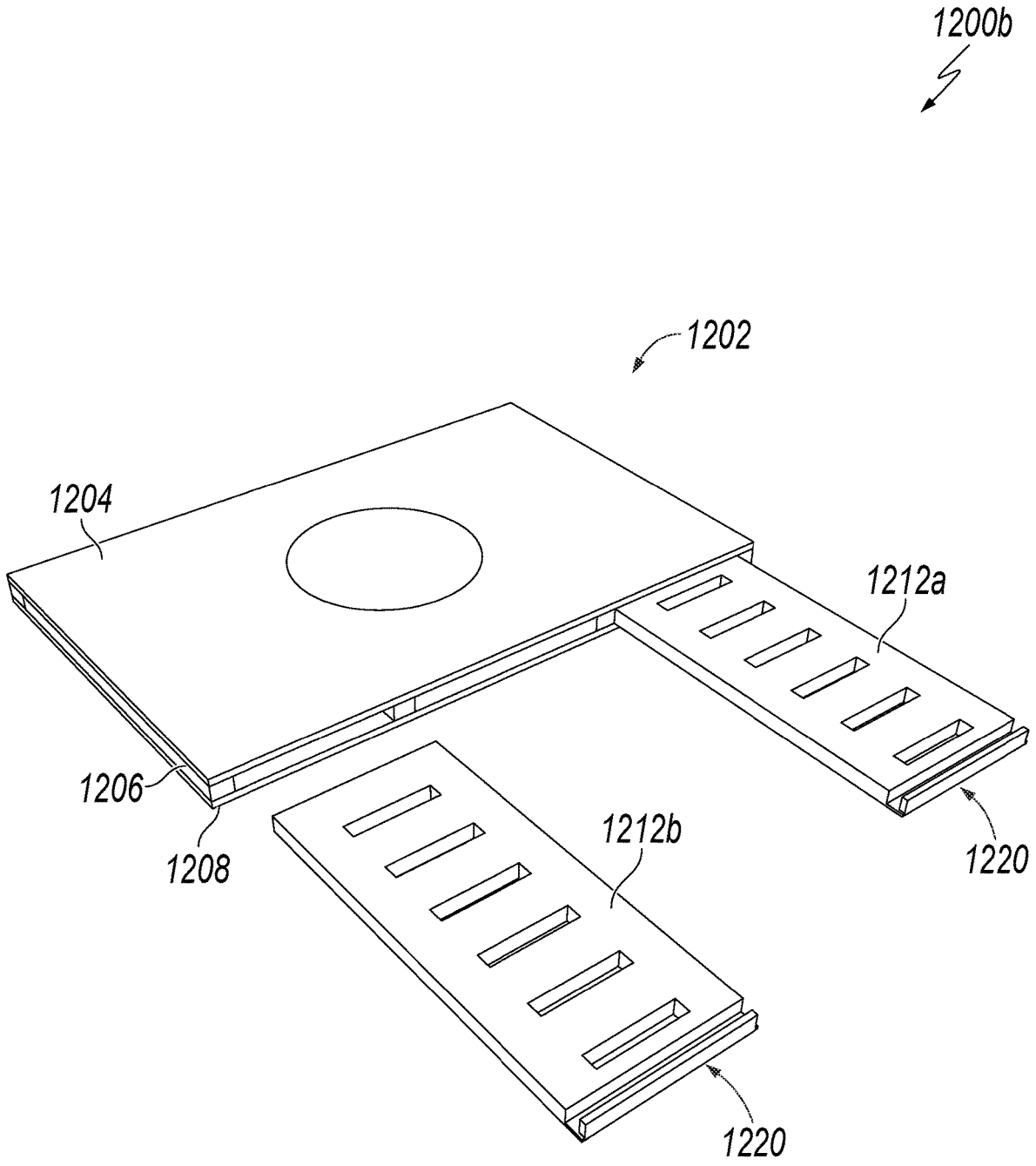

FIG. 12B a perspective drawing 1200*b* of the alternative STP 1202 with balance beam panels 1212*a*/1212*b* removed for assembly. Each balance beam panel 1212*a*/1212*b* is configured with the interlocking member 1220 configured to engage with both the balance beam engagement slot 1218 and another balance beam panel (for example, by mechanically 5 engaging to the end of either balance beam panel 1212*a*/1212*b* using a corresponding interlocking member 1220). One end of each balance beam panel 1212*a*/1212*b* is also configured to engage with the interlocking member 1220 of the other balance beam panel.

Figure 12C:
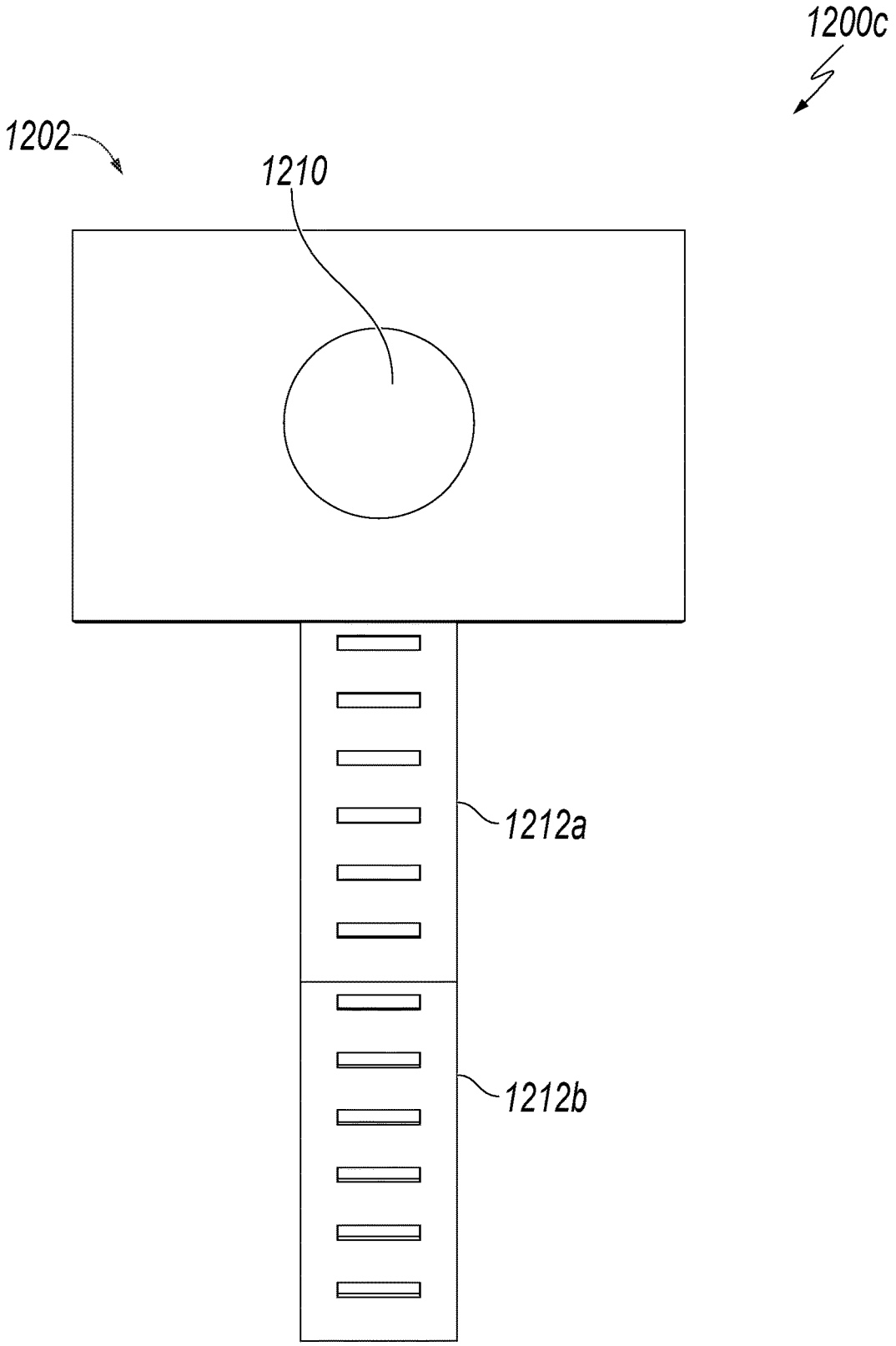

For example, turning to FIG. 12C, FIG. 12C is a top view drawing 1200*c* illustrating balance beam panel 1212*a* coupled to the balance beam engagement slot 1218 (not illustrated) of the alternative STP 1202 by using interlocking member 1220 (not illustrated), and balance beam panel 1212*b* has been coupled to the attached first balance beam panel 1212*a* using the interlocking member 1220 (not illustrated) on balance beam panel 1212*b*. In this configuration, the non-coupled end of balance beam panel 1212*b* presents a flat surface.

FIGS. 12D1-12D3 are a bottom view drawing 1200*d*1-1200*d*3 of the alternative STP 1202. FIGS. 12D1-12D3 illustrate a slightly different configuration of the described balance beam panels 1212*a*/1212*b* with respect to the remaining components of the alternative STP 1202. In this implementation, each of the ends of the balance beam panels 1212*a*/1212*b* proximate to the interlocking members 1220 have truncated corners (for example, as identified at 1222).

The configuration of FIGS. 12D1-12D3 also illustrate three rotational stop limiters 1216 on the bottom surface of the rotational plate 1210. In some implementations, there can be more or fewer rotational stop limiters 1216. The rotational stop limiters 1216 are configured in such a way to only permit the rotational plate 1210 to rotate a particular angular distance either clockwise or counter-clockwise from a starting position. When the rotational plate 1210 is rotating, one or more of the rotational stop limiters 1216 make contact with a surface of the center frame 1206, which retards further circular motion of the rotational plate 1210.

FIGS. 12D1-12D3 also illustrate pockets 1224*a*/1224*b* (corresponding to pockets 304*a*/304*b* and pockets 1114*a*/114*b* of FIGS. 3 and 11D1, respectively).

FIGS. 12E, 12F1-12F2, and 12G1-12G2 are dimensional drawings 1200*e*, 1200*f*1-1200*f*2, and 1200*g*1-1200*g*2, respectively, of the various components of the alternative STP 1202 described in FIGS. 12A-12C, and 12D1-12D3. FIGS. 12E, 12F1-12F2, and 12G1-12G2 illustrate one or more particular implementations with respect to size and configuration to assist with understanding of the described STP concept. With respect to material that is within the scope of the disclosure, FIGS. 12E, 12F1-12F2, and 12G1-12G2 are not meant to limit the disclosure in any way. Other dimensional values and materials within the scope of this disclosure are also considered to be within the scope of the disclosure.

Figure 12E:
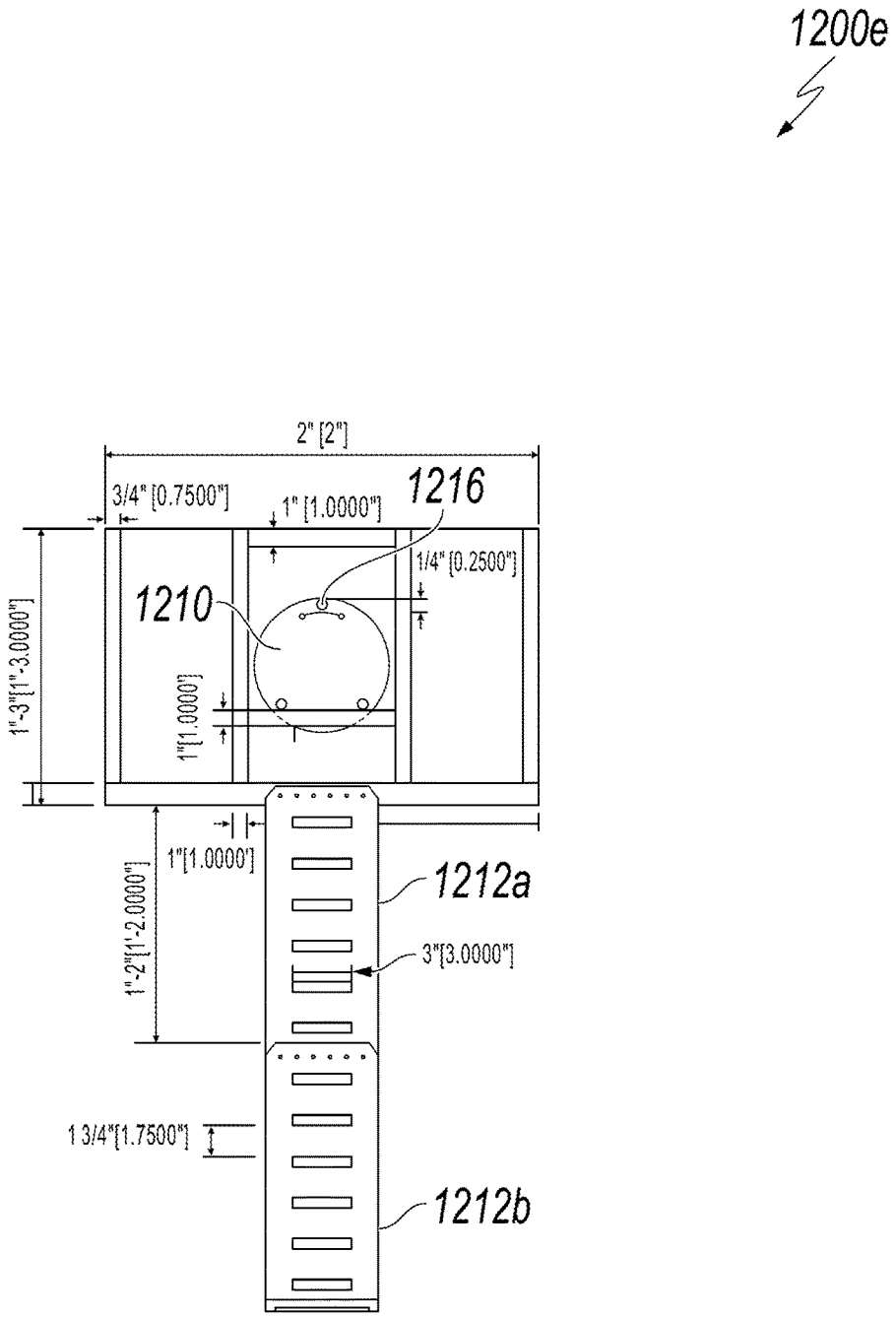

FIG. 12E illustrates example dimensions of a bottom view of an implementation of the alternative STP 1202. FIGS. 12F1-12F2 illustrate an edge view of an implementation of the alternative STP 1202. In FIGS. 12F1-12F2, the view is from the perspective of looking into the pockets 1224*a*/1224*b* that hold the balance beam panels 1212*a*/1212*b*, respectively. FIGS. 12G1-12G2 illustrate example dimensions of view of an implementation of the relationship between the alternative STP 1202 and balance beam panels 1212*a*/1212*b* when set up for use of the alternative STP 1202.

Figure 13:
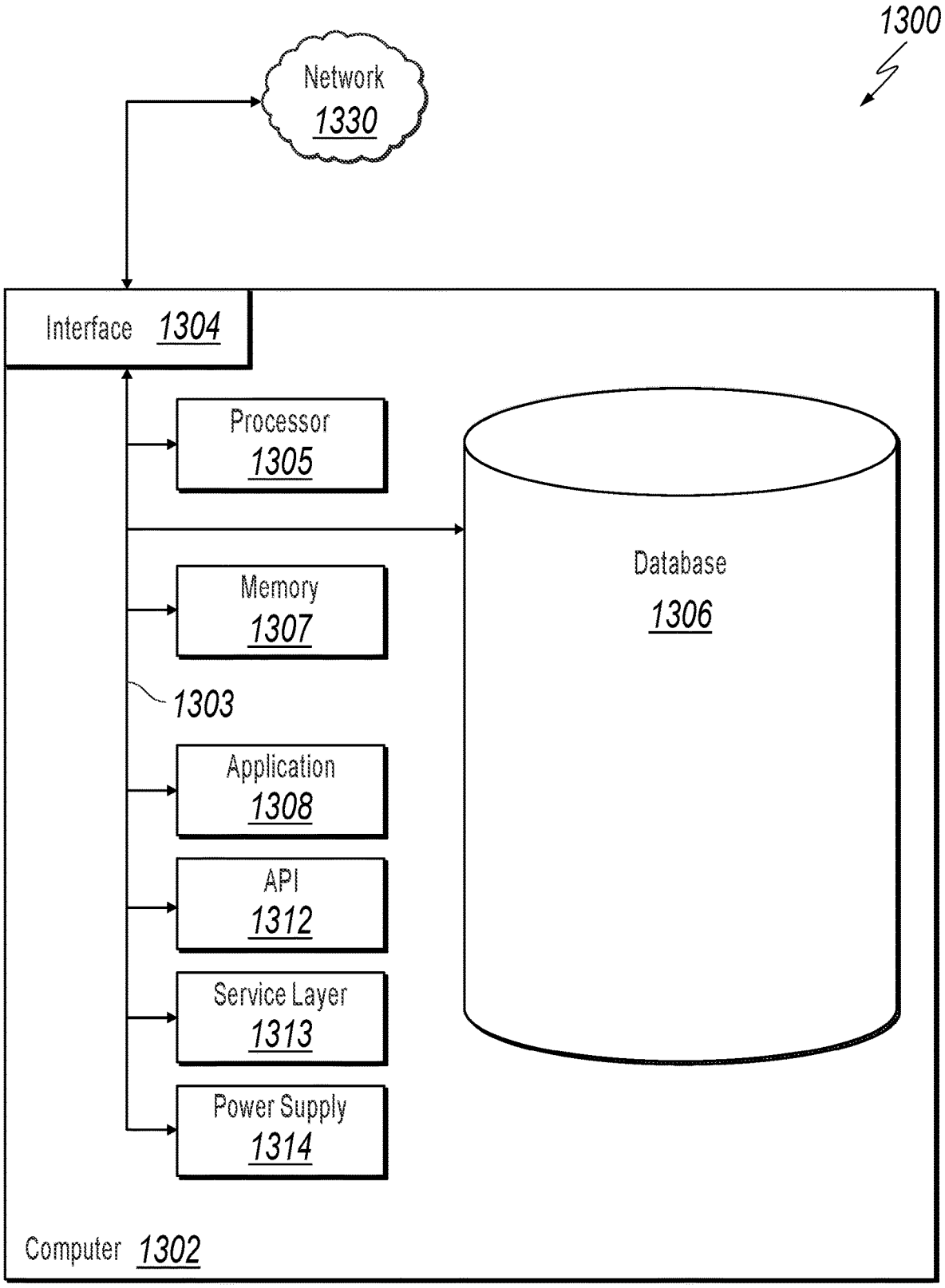
FIG. 13 is a block diagram illustrating an example of a computer-implemented system used to provide, in some implementations, computational functionalities associated with described algorithms, methods, functions, processes, flows, and procedures, according to an implementation of the disclosure.

FIG. 13 is a block diagram illustrating an example of a computer 15 implemented System 1300 used to provide computational functionalities associated with described algorithms, methods, functions, processes, flows, and procedures, according to an implementation of the disclosure.

In the illustrated implementation, System 1300 includes a Computer 1302 and a Network 1330.

The illustrated Computer 1302 is intended to encompass any computing 20 device, such as a server, desktop computer, laptop/notebook computer, wireless data port, smart phone, personal data assistant (PDA), tablet computer, one or more processors within these devices, or a combination of computing devices, including physical or virtual instances of the computing device, or a combination of physical or virtual instances of the computing device. Additionally, the Computer 1302 can include 25 an input device, such as a keypad, keyboard, or touch screen, or a combination of input devices that can accept user information, and an output device that conveys information associated with the operation of the Computer 1302, including digital data, visual, audio, another type of information, or a combination of types of information, on a graphical type user interface (UI) (or GUI) or other UI.

The Computer 1302 can serve in a role in a distributed computing system as, for example, a client, network component, a server, or a database or another persistency, or a combination of roles for performing the subject matter described in the disclosure. The illustrated Computer 1302 is communicably coupled with a Network 1330. In some implementations, one or more components of the Computer 1302 can be configured to operate within an environment, or a combination of environments, including cloud-computing, local, or global.

At a high level, the Computer 1302 is an electronic computing device operable to receive, transmit, process, store, or manage data and information associated with the described subject matter. According to some implementations, the Computer 1302 can also include or be communicably coupled with a server, such as an application server, e-mail server, web server, caching server, or streaming data server, or a combination of servers.

The Computer 1302 can receive requests over Network 1330 (for example, from a client software application executing on another Computer 1302) and respond to the received requests by processing the received requests using a software application or a combination of software applications. In addition, requests can also be sent to the Computer 1302 from internal users (for example, from a command console or by another internal access method), external or third-parties, or other entities, individuals, systems, or computers.

Each of the components of the Computer 1302 can communicate using a System Bus 1303. In some implementations, any or all of the components of the Computer 1302, including hardware, software, or a combination of hardware and software, can interface over the System Bus 1303 using an application programming interface (API) 1312, a Service Layer 1313, or a combination of the API 1312 and Service Layer 1313. The API 1312 can include specifications for routines, data structures, and object classes. The API 1312 can be either computer-language independent or dependent and refer to a complete interface, a single function, or even a set of APIs. The Service Layer 1313 provides software services to the Computer 1302 or other components (whether illustrated or not) that are communicably coupled to the Computer 1302. The functionality of the Computer 1302 can be accessible for all service consumers using the Service Layer 1313. Software services, such as those provided by the Service Layer 1313, provide reusable, defined functionalities through a defined interface. For example, the interface can be software written in a computing language (for example JAVA or C++) or a combination of computing languages, and providing data in a particular format (for example, extensible markup language (XML)) or a combination of formats. While illustrated as an integrated component of the Computer 1302, alternative implementations can illustrate the API 1312 or the Service Layer 1313 as stand-alone components in relation to other components of the Computer 1302 or other components (whether illustrated or not) that are communicably coupled to the Computer 1302. Moreover, any or all parts of the API 1312 or the Service Layer 1313 can be implemented as a child or a sub-module of another software module, enterprise application, or hardware module without departing from the scope of the disclosure.

The Computer 1302 includes an Interface 1304. Although illustrated as a single Interface 1304, two or more Interfaces 1304 can be used according to particular needs, desires, or particular implementations of the Computer 1302. The Interface 1304 is used by the Computer 1302 for communicating with another computing system (whether illustrated or not) that is communicatively linked to the Network 1330 in a distributed environment. Generally, the Interface 1304 is operable to communicate with the Network 1330 and includes logic encoded in software, hardware, or a combination of software and hardware. More specifically, the Interface 1304 can include software supporting one or more communication protocols associated with communications such that the Network 1330 or hardware of Interface 1304 is operable to communicate physical signals within and outside of the illustrated Computer 1302.

The Computer 1302 includes a Processor 1305. Although illustrated as a single Processor 1305, two or more Processors 1305 can be used according to particular needs, desires, or particular implementations of the Computer 1302. Generally, the Processor 1305 executes instructions and manipulates data to perform the operations of the Computer 1302 and any algorithms, methods, functions, processes, flows, and procedures as described in the disclosure.

The Computer 1302 also includes a Database 1306 that can hold data for the Computer 1302, another component communicatively linked to the Network 1330 (whether illustrated or not), or a combination of the Computer 1302 and another component. For example, Database 1306 can be an in-memory or conventional database storing data consistent with the disclosure. In some implementations, Database 1306 can be a combination of two or more different database types (for example, a hybrid in-memory and conventional database) according to particular needs, desires, or particular implementations of the Computer 1302 and the described functionality. Although illustrated as a single Database 1306, two or more databases of similar or differing types can be used according to particular needs, desires, or particular implementations of the Computer 1302 and the described functionality. While Database 1306 is illustrated as an integral component of the Computer 1302, in alternative implementations, Database 1306 can be external to the Computer 1302.

The Computer 1302 also includes a Memory 1307 that can hold data for the Computer 1302, another component or components communicatively linked to the Network 1330 (whether illustrated or not), or a combination of the Computer 1302 and another component. Memory 1307 can store any data consistent with the disclosure. In some implementations, Memory 1307 can be a combination of two or more different types of memory (for example, a combination of semiconductor and magnetic storage) according to particular needs, desires, or particular implementations of the Computer 1302 and the described functionality. Although illustrated as a single Memory 1307, two or more Memories 1307 or similar or differing types can be used according to particular needs, desires, or particular implementations of the Computer 1302 and the described functionality. While Memory 1307 is illustrated as an integral component of the Computer 1302, in alternative implementations, Memory 1307 can be external to the Computer 1302.

The Application 1308 is an algorithmic software engine providing functionality according to particular needs, desires, or particular implementations of the Computer 1302, particularly with respect to functionality described in the disclosure. For example, Application 1308 can serve as one or more components, modules, or applications. Further, although illustrated as a single Application 1308, the Application 1308 can be implemented as multiple Applications 1308 on the Computer 1302. In addition, although illustrated as integral to the Computer 1302, in alternative implementations, the Application 1308 can be external to the Computer 1302.

The Computer 1302 can also include a Power Supply 1314. The Power Supply 1314 can include a rechargeable or non-rechargeable battery that can be configured to be either user- or non-user-replaceable. In some implementations, the Power Supply 1314 can include power-conversion or management circuits (including recharging, standby, or another power management functionality). In some implementations, the Power Supply 1314 can include a power plug to allow the Computer 1302 to be plugged into a wall socket or another power source to, for example, power the Computer 1302 or recharge a rechargeable battery.

There can be any number of Computers 1302 associated with, or external to, a computer system containing Computer 1302, each Computer 1302 communicating over Network 1330. Further, the term "client," "user," or other appropriate terminology can be used interchangeably, as appropriate, without departing from the scope of the disclosure. Moreover, the disclosure contemplates that many users can use one Computer 1302, or that one user can use multiple computers 1302.

In some implementations, an STP can be configured to include one or more computers, processors, and/or other components, for example, as described in FIG. 13. In some implementations, an STP can be configured to include one or more sensors. Sensors can include one or more devices to determine player weight (for example, a scale), balance, front/back foot pressure (for example, pressure meter or gauge), and/or foot/hip rotational distance (for example, a resonator). Sensors can also include an accelerometer, gyroscope, thermometer, barometer, hygrometer, or other sensors consistent with the concepts described in this disclosure. The gathered analytical data can be used to analyze/track, among other things, player performance, body positon improvement, and training goals.

In some implementations, an STP can be configured with one or more light emitting diodes (LEDs), a display (or example, a liquid crystal display (LCD) or organic light emitting diode (OLED) display), battery indicator, haptic feedback device, and/or audio speaker. In some implementations, these devices can be used to provide various notifications/feedback (for example, audio, visual, and/or haptic) to players, coaches, trainers, parents, or others. For example, if a player exerts a preferred amount of back/front foot pressure, the STP can glow with green light, whereas if pressure is outside of a determined threshold, the STP can glow with a red light or identify a particular foot using an LED indicator. In another example, haptic feedback can be used to help a player evenly distribute pressure on the STP Some implementations of an STP can also include computer network functionality (for example, wired or wireless functionality can permit sensor data collected for a particular player to be gathered, saved, stored, and/or transmitted to remote computers/applications for review by players, coaches, trainers, parents, or others. In an example, a coach can use a mobile computing device with associated software on the mobile computing device and STP to configure an STP (for example, for a particular player), receive data from the STP based on usage, analyze the data, and provide reports (for example, to the particular player) as to training goals.

Some implementations of an STP can be configured to hold one or more batteries (either user replaceable or internal). In some implementations, the batteries can be rechargeable. The STP can also be configured to inform users of a current battery level (for example, on a display, using LEDs, or on a software application). In some implementations, the STP can be configured with one or more connectors (for example, universal serial bus (USB), power, or audio-type jacks) to provide power to the STP or to transmit data in/receive data from the STP.

Some implementations of the STP can also be configured with internal and/or replaceable computer memory to store data consistent with this disclosure. For example, the STP can be configured with a secure digital (SD)-type card slot. A coach can use a separate SD card for each player on a team to securely store data associated with the STP for the player.

While this specification contains many specific implementation details, these should not be construed as limitations on the scope of any invention, but rather as descriptions of features that may be specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable sub-combination. Moreover, although features may be described above as acting in certain combinations, one or more features from a described combination can in some cases be excised from the combination, and the combination may be directed to a sub-combination or variation of a sub-combination.

Particular implementations of the subject matter have been described. Other implementations, alterations, and permutations of the described implementations are considered to be within the scope of disclosure. Moreover, the separation or integration of various system modules or components in the implementations described above should not be understood as requiring such separation or integration in all implementations. Accordingly, the above description of example implementations does not define or constrain this disclosure. Other changes, substitutions, combinations, and alterations of the described components are also possible without departing from the spirit and scope of this disclosure.

Some implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs, that is, one or more modules of computer program instructions encoded on a tangible, non-transitory, computer-readable medium for execution by, or to control the operation of, a computer or computer-implemented system. Alternatively, or additionally, the program instructions can be encoded in/on an artificially generated propagated signal, for example, a machine-generated electrical, optical, or electromagnetic signal that is generated to encode information for transmission to a receiver apparatus for execution by a computer or computer-implemented system. The computer-storage medium can be a machine-readable storage device, a machine-readable storage substrate, a random or serial access memory device, or a combination of computer-storage mediums. Configuring one or more computers means that the one or more computers have installed hardware, firmware, or software (or combinations of hardware, firmware, and software) so that when the software is executed by the one or more computers, particular computing operations are performed.

The term "real-time," "real time." "realtime," "real (fast) time (RFT)," "near(ly) real-time (NRT)." "quasi real-time," or similar terms (as understood by one of ordinary skill in the art), means that an action and a response are temporally proximate such that an individual perceives the action and the response occurring substantially simultaneously. For example, the time difference for a response to display (or for an initiation of a display) of data following the individual's action to access the data can be less than 1 millisecond (ms), less than 1 second (s), or less than 5 s. While the requested data need not be displayed (or initiated for display) instantaneously, it is displayed (or initiated for display) without any intentional delay, taking into account processing limitations of a described computing system and time required to, for example, gather, accurately measure, analyze, process, store, or transmit the data.

The terms "data processing apparatus." "computer." or "electronic computer device" (or an equivalent term as understood by one of ordinary skill in the art) refer to data processing hardware and encompass all kinds of apparatuses, devices, and machines for processing data, including by way of example, a programmable processor, a computer, or multiple processors or computers. The computer can also be, or further include special-purpose logic circuitry, for example, a central processing unit (CPU), a field programmable gate array (FPGA), or an application-specific integrated circuit (ASIC). In some implementations, the computer or computer-implemented system or special-purpose logic circuitry (or a combination of the computer or computer-implemented system and special-purpose logic circuitry) can be hardware- or software-based (or a combination of both hardware- and software-based). The computer can optionally include code that creates an execution environment for computer programs, for example, code that constitutes processor firmware, a protocol stack, a database management system, an operating system, or a combination of execution environments. The disclosure contemplates the use of a computer or computer-implemented system with an operating system, for example LINUX, UNIX, WINDOWS, MAC OS, ANDROID, or IOS, or a combination of operating systems.

A computer program, which can also be referred to or described as a program, software, a software application, a unit, a module, a software module, a script code, or other component can be written in any form of programming language, including compiled or interpreted languages, or declarative or procedural languages, and it can be deployed in any form, including, for example, as a stand-alone program, module, component, or subroutine, for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files, for example, files that store one or more modules, sub-programs, or portions of code. A computer program can be deployed to be executed on one computer or on multiple computers that are located at one site or distributed across multiple sites and interconnected by a communication network.

While portions of the programs illustrated in the various figures can be illustrated as individual components, such as units or modules, that implement described features and functionality using various objects, methods, or other processes, the programs can instead include a number of sub-units, sub-modules, third-party services, components, libraries, and other components, as appropriate. Conversely, the features and functionality of various components can be combined into single components, as appropriate. Thresholds used to make computational determinations can be statically, dynamically, or both statically and dynamically determined.

Described methods, processes, or logic flows represent one or more examples of functionality consistent with the disclosure and are not intended to limit the disclosure to the described or illustrated implementations, but to be accorded the widest scope consistent with described principles and features. The described methods, processes, or logic flows can be performed by one or more programmable computers executing one or more computer programs to perform functions by operating on input data and generating output data. The methods, processes, or logic flows can also be performed by, and computers can also be implemented as, special-purpose logic circuitry, for example, a CPU, an FPGA, or an ASIC.

Computers for the execution of a computer program can be based on general or special-purpose microprocessors, both, or another type of CPU. Generally, a CPU will receive instructions and data from and write to a memory. The essential elements of a computer are a CPU, for performing or executing instructions, and one or more memory devices for storing instructions and data. Generally, a computer will also include, or be operatively coupled to, receive data from or transfer data to, or both, one or more mass storage devices for storing data, for example, magnetic, magneto-optical disks, or optical disks. However, a computer need not have such devices. Moreover, a computer can be embedded in another device, for example, a mobile telephone, a personal digital assistant (PDA), a mobile audio or video player, a game console, a global positioning system (GPS) receiver, or a portable memory storage device.

Non-transitory computer-readable media for storing computer program instructions and data can include all forms of permanent/non-permanent or volatile/non-volatile memory, media and memory devices, including by way of example semiconductor memory devices, for example, random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices: magnetic devices, for example, tape, cartridges, cassettes, internal/removable disks: magneto-optical disks; and optical memory devices, for example, digital versatile/video disc (DVD), compact disc (CD)-ROM, DVD+/–R, DVD-RAM, DVD-ROM, high-definition/density (HD)-DVD, and BLU-RAY/BLU- RAY DISC (BD), and other optical memory technologies. The memory can store various objects or data, including caches, classes, frameworks, applications, modules, backup data, jobs, web pages, web page templates, data structures, database tables, repositories storing dynamic information, or other appropriate information including any parameters, variables, algorithms, instructions, rules, constraints, or references. Additionally, the memory can include other appropriate data, such as logs, policies, security or access data, or reporting files. The processor and the memory can be supplemented by, or incorporated in, special-purpose logic circuitry.

To provide for interaction with a user, implementations of the subject matter described in this specification can be implemented on a computer having a display device, for example, a cathode ray tube (CRT), liquid crystal display (LCD), light emitting diode (LED), or plasma monitor, for displaying information to the user and a keyboard and a pointing device, for example, a mouse, trackball, or trackpad by which the user can provide input to the computer. Input can also be provided to the computer using a touchscreen, such as a tablet computer surface with pressure sensitivity or a multi-touch screen using capacitive or electric sensing. Other types of devices can be used to interact with the user. For example, feedback provided to the user can be any form of sensory feedback (such as, visual, auditory, tactile, or a combination of feedback types). Input from the user can be received in any form, including acoustic, speech, or tactile input. In addition, a computer can interact with the user by sending documents to and receiving documents from a client computing device that is used by the user (for example, by sending web pages to a web browser on a user's mobile computing device in response to requests received from the web browser).

The term "graphical user interface," or "GUI," can be used in the singular or the plural to describe one or more graphical user interfaces and each of the displays of a particular graphical user interface. Therefore, a GUI can represent any graphical user interface, including but not limited to, a web browser, a touch screen, or a command line interface (CLI) that processes information and efficiently presents the information results to the user. In general, a GUI can include a number of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server, or that includes a front-end component, for example, a client computer having a graphical user interface or a Web browser through which a user can interact with an implementation of the subject matter described in this specification, or any combination of one or more such back-end, middleware, or front-end components. The components of the system can be interconnected by any form or medium of wireline or wireless digital data communication (or a combination of data communication), for example, a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n or 802.20 (or a combination of 802.11x and 802.20 or other protocols consistent with the disclosure), all or a portion of the Internet, another communication network, or a combination of communication networks. The communication network can communicate with, for example, Internet Protocol (IP) packets, frame relay frames, Asynchronous Transfer Mode (ATM) cells, voice, video, data, or other information between network nodes.

The computing system can include clients and servers. A client and server are generally remote from each other and typically interact through a communication network. The relationship of client and server arises by virtue of computer programs running on the respective computers and having a client-server relationship to each other.

The separation or integration of various system modules and components in the previously described implementations should not be understood as requiring such separation or integration in all implementations, and it should be understood that the described program components and systems can generally be integrated together in a single software product or packaged into multiple software products.

While operations may be depicted in the drawings or claims in a particular order, this should not be understood as requiring that such operations be performed in the particular order shown or in sequential order, or that all illustrated operations be performed (some operations can be considered optional), to achieve desirable results. In certain circumstances, multitasking or parallel processing (or a combination of multitasking and parallel processing) can be advantageous and performed as deemed appropriate.

In some implementations, a particular claimed implementation can be considered to be applicable with respect to one or more of a computer-implemented method: a non-transitory, computer-readable medium storing computer-readable instructions to perform the computer-implemented method: or a computer system comprising a computer memory interoperably coupled with a hardware processor configured to perform the computer-implemented method or the instructions stored on the non-transitory, computer-readable medium.

What is claimed is:

1. A bat-and-ball swing training platform (STP) apparatus, comprising:

a center frame coupled to a front panel and to a rear panel to create an STP base;

a rotational platform coupled to the center frame and accessible through the front panel for rotationally supporting a user's foot;

two balance beam panels, wherein pockets defined by the center frame are configured for retention of the two balance beam panels fully within the STP base; and a balance beam engagement slot used to couple one balance beam panel of the two balance beam panels to the STP base with a first interlocking member configured on a first end of the one balance beam panel, wherein the one balance beam is configured on a second end with an interlock slot to couple with a second interlocking member configured on an end of a second balance beam panel of the two balance beam panels, and wherein the two balance beam panels are coupled together linearly to create the balance beam.

2. The apparatus of claim 1, wherein the front panel, the center frame, and the rear panel are configured to define a carry handle.

3. The apparatus of claim 1, wherein each balance beam panel of the two balance beam panels are retained in the pockets by friction, clip, clamp, or retaining band.

4. The apparatus of claim 1, wherein the rotational platform is configured with a rotational limiter.

5. The apparatus of claim 4, wherein the center frame is configured with a rotational limiter base that mechanically couples with the rotational limiter of the rotational platform to limit rotation of the rotational platform to within a defined rotational angle.

6. The apparatus of claim 1, wherein the rear panel and the center frame are configured to define the balance beam engagement slot.

7. The apparatus of claim 1, wherein each balance beam panel is configured with a plurality of adjustment slots.

8. The apparatus of claim 7, further comprising an adjustable forefoot block that is inserted into an adjustment slot of the plurality of adjustment slots to limit the width of the user's stance when a rear foot is placed on the rotational platform and a side of a front foot is placed against the forefoot block.

9. The apparatus of claim 1, further comprising one or more computers and one or more computer memory devices interoperably coupled with the one or more computers and having tangible, non-transitory, machine-readable media storing one or more instructions that, when executed by the one or more computers, perform one or more operations.

10. The apparatus of claim 9, further comprising one or more network devices for transmitting and receiving data.

11. The apparatus of claim 9, further comprising audio, visual, or haptic indicators.

12. The apparatus of claim 9, further comprising a computer display.

13. The apparatus of claim 9, further comprising software to interface with an external computing device for configuration.

14. The apparatus of claim 9, further comprising one or more sensors for gathering analytical data.

15. The apparatus of claim 14, wherein the sensors include a scale, pressure meter, resonator, accelerometer, gyroscope, thermometer, barometer, or hygrometer.

* * * * *